US009885541B2

(12) United States Patent
Meinert et al.

(10) Patent No.: US 9,885,541 B2
(45) Date of Patent: Feb. 6, 2018

(54) RIFLESCOPE AIMING SYSTEM

(71) Applicant: VISTA OUTDOOR OPERATIONS LLC, Clearfield, UT (US)

(72) Inventors: Robert J. Meinert, Andover, MN (US); William P. Atwood, Cood Rapids, MN (US); Thomas Kramer, Andover, MN (US); Brent R. Cook, Blaine, MN (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 14/774,680

(22) PCT Filed: Mar. 15, 2014

(86) PCT No.: PCT/US2014/030025
§ 371 (c)(1),
(2) Date: Sep. 10, 2015

(87) PCT Pub. No.: WO2014/145288
PCT Pub. Date: Sep. 18, 2014

(65) Prior Publication Data

US 2016/0025454 A1 Jan. 28, 2016

Related U.S. Application Data

(60) Provisional application No. 61/800,495, filed on Mar. 15, 2013.

(51) Int. Cl.
*F41G 1/387* (2006.01)
*F41G 1/38* (2006.01)
(Continued)

(52) U.S. Cl.
CPC ..... *F41G 1/387* (2013.01); *F41C 23/16* (2013.01); *F41G 1/18* (2013.01); *F41G 1/38* (2013.01)

(58) Field of Classification Search
CPC ..... F41G 1/387; F41G 1/38
(Continued)

(56) References Cited

U.S. PATENT DOCUMENTS 3,280,463 A 10/1966 Stadler
3,990,155 A 11/1976 Akin, Jr. et al.
(Continued)

FOREIGN PATENT DOCUMENTS

DE 30 04 635 A1 8/1981
WO WO 97/37193 A1 10/1997
(Continued)

OTHER PUBLICATIONS

"Leupold & Stevens VXR 4-12x50mm Ballistic Firedot Illuminated Riflescope—Matte", retrieved from internet on Feb. 21, 2014 (2 pgs.).
(Continued)

*Primary Examiner* — Reginald Tillman, Jr.
(74) *Attorney, Agent, or Firm* — Christensen, Fonder, Dardi & Herbert PLLC

(57) ABSTRACT

A riflescope aiming system that includes a telescopic sight, a multiple-zero-point elevation turret and a ballistics reference system. The multiple-zero-point elevation turret includes a rotatable indicator carrier and a plurality of indicator pins secured to the indicator carrier, each indicator pin corresponding to a predetermined target distance. The ballistics reference system is operably coupled to the objective housing of the telescopic sight and displays ballistics data indicia.

17 Claims, 24 Drawing Sheets

(51) Int. Cl.
*F41G 1/18* (2006.01)
*F41C 23/16* (2006.01)

(58) Field of Classification Search
USPC ..... 42/111, 119, 120, 122, 129, 140–144, 42/147, 148
See application file for complete search history.

(56) References Cited

U.S. PATENT DOCUMENTS

| | | | | |
|---|---|---|---|---|
| 4,392,723 | A | 7/1983 | Gehmann | |
| 4,806,007 | A | 2/1989 | Bindon | |
| 5,406,733 | A * | 4/1995 | Tarlton | F41G 1/44 33/292 |
| 5,442,860 | A * | 8/1995 | Palmer | F41G 1/545 33/286 |
| 5,557,871 | A | 9/1996 | LaLonde | |
| 5,715,607 | A | 2/1998 | Murg | |
| 5,878,504 | A * | 3/1999 | Harms | F41G 1/545 33/286 |
| 6,279,259 | B1 | 8/2001 | Otteman | |
| 6,289,625 | B1 * | 9/2001 | Phares | F41G 1/383 42/111 |
| 6,643,970 | B2 | 11/2003 | Huber | |
| 6,772,550 | B1 | 8/2004 | Leatherwood | |
| 6,811,268 | B2 * | 11/2004 | Watson | F41G 1/383 359/511 |
| 7,185,455 | B2 | 3/2007 | Zaderey | |
| 7,581,346 | B2 | 9/2009 | Klepp et al. | |
| 7,584,570 | B2 | 9/2009 | Smith | |
| 7,624,526 | B2 * | 12/2009 | Paasikivi | F41G 1/38 42/111 |
| 7,827,723 | B1 | 11/2010 | Zaderey et al. | |
| 7,827,725 | B1 | 11/2010 | Hagler | |
| 7,832,137 | B2 | 11/2010 | Sammut et al. | |
| 7,905,046 | B2 | 3/2011 | Smith, III | |
| 7,913,440 | B2 | 3/2011 | Murg et al. | |
| 7,946,073 | B1 | 5/2011 | Buck | |
| 8,091,268 | B2 | 1/2012 | York | |
| 8,166,696 | B2 | 5/2012 | Hamilton | |
| 8,166,697 | B1 | 5/2012 | Sueskind | |
| 8,230,635 | B2 | 7/2012 | Sammut et al. | |
| 8,286,383 | B2 | 10/2012 | Matthews | |
| 8,286,384 | B2 | 10/2012 | Zaderey et al. | |
| 8,353,454 | B2 | 1/2013 | Sammut et al. | |
| 8,397,420 | B2 | 3/2013 | Hamilton | |
| 2002/0078616 | A1 | 6/2002 | Perry et al. | |
| 2002/0159148 | A1 | 10/2002 | Huber | |
| 2004/0144013 | A1 | 7/2004 | Leatherwood | |
| 2005/0229468 | A1 | 10/2005 | Zaderey et al. | |
| 2005/0257414 | A1 | 11/2005 | Zaderey et al. | |
| 2007/0240356 | A1 | 10/2007 | Klepp et al. | |
| 2008/0066364 | A1 | 3/2008 | Klepp et al. | |
| 2008/0289239 | A1 | 11/2008 | Menges et al. | |
| 2009/0049733 | A1 | 2/2009 | Matthews | |
| 2009/0064561 | A1 * | 3/2009 | Piltonen | F41G 1/38 42/119 |
| 2010/0229451 | A1 | 9/2010 | Hamilton | |
| 2010/0307047 | A1 * | 12/2010 | Long | F41G 1/06 42/119 |
| 2012/0113507 | A1 | 5/2012 | Arai | |
| 2012/0137567 | A1 | 6/2012 | Sammut | |
| 2013/0014421 | A1 | 1/2013 | Sammut et al. | |
| 2013/0170027 | A1 | 7/2013 | Peters et al. | |
| 2013/0276345 | A1 | 10/2013 | Hamilton | |
| 2013/0286472 | A1 | 10/2013 | Arai et al. | |
| 2014/0000146 | A1 | 1/2014 | Davidson | |
| 2015/0285589 | A1 * | 10/2015 | Hamilton | F41G 1/383 42/143 |

FOREIGN PATENT DOCUMENTS

| | | | |
|---|---|---|---|
| WO | WO 99/30101 | A1 | 6/1999 |
| WO | WO 2006/003265 | A1 | 1/2006 |
| WO | WO 2006/017868 | A1 | 2/2006 |
| WO | WO 2006/017869 | A1 | 2/2006 |
| WO | WO 2008/091388 | A2 | 7/2008 |
| WO | WO 2013/106280 | A1 | 7/2013 |

OTHER PUBLICATIONS

"E. Arthur Brow Company On-Line Shopping Cart," http://www.eabco.com/Reports/report0.html, retrieved from the internet on Feb. 21, 2014 (5 pgs.).
"Redfield/Revolution™ & Revolution/Tactm Product Brochure," retrieved from the internet on Feb. 22, 2014 (14 pgs.).
"2009 BARSKA Sports Optics Catalog/Riflescopes," retrieved from the internet on Feb. 21, 2014 (29 pgs.).

* cited by examiner

RIFLESCOPE AIMING SYSTEM

PRIORITY CLAIM

The present application claims the benefit of U.S. Provisional Application No. 61/800,495 filed Mar. 15, 2013, which is incorporated herein by reference in its entirety.

FIELD OF THE INVENTION

The present invention is directed generally to a riflescope aiming system. Specifically, the present invention is directed to a riflescope with a multiple-zero-point turret with adjustable distance indicia, and a ballistics reference system for quickly and easily determining turret indicia set-points based on user-inputted ammunition, rifle, and atmospheric characteristics.

BACKGROUND

Many firearms, such as rifles, are equipped with optical sights, which use optics that provide the user with an image of an aligned aiming point or pattern, commonly known as a reticle, superimposed at the same focus as the target.

When shooting at long distances, shooters must adjust their aim to take into account the downward acceleration of the projectile imparted by gravity, which is often referred to as "bullet drop." This is typically done by adjusting the angular position of the riflescope relative to the rifle barrel using an elevation turret.

A zero point for a riflescope is determined when "sighting" a rifle at a known distance by adjusting the angular position of the riflescope relative to the rifle barrel, via the elevation turret, until the impact point of the bullet matches the point on the target coincident with the optical center of the riflescope reticle. For targets at distances greater than the distance used for establishing the riflescope's zero point, the elevation turret is used to adjust the angular position of the scope with respect to the rifle barrel to compensate for the greater amount of bullet drop.

The vast majority of hunting riflescopes have a single elevation zero point that is set to a single distance or elevation, e.g., 200 yards. Unless the riflescope's turret can be adjusted to match further distances beyond a single zero point, it is impossible to accurately and swiftly predict where a bullet will impact at middle to long distances without additional rapid adjustment aids.

Recently, riflescopes have been developed that include a turret with multiple indicators, each representing a zero point for various distances. Thus, a shooter can select an index indicator that corresponds to the distance of his target to adjust his riflescope to the proper elevation. One example of this type of riflescope is disclosed in U.S. Patent Publication No. 2008/0289239 to Menges et al. (hereinafter referred to as Menges).

Menges discloses a riflescope turret with an inner coupling device surrounded by annular stacking indexing elements. Since the indexing elements stack on top of one another, the number of indexing elements that can be used is limited by their thickness with respect to the height of the coupler. As disclosed, a maximum of four indexing elements can be used, which limits resolution and accuracy potential.

The number of available zero points or stops corresponds to the turret's elevation resolution; therefore, fewer zero stops correspond to larger distances between zero stop set points, which in turn results in a larger margin of error for distances between zero stops. For example, if a shooter wanted to calibrate his riflescope for a range of 100 to 500 yards and had three available zero stops, he could set the zero stops at 100, 300, and 500 yards, respectively. However, if five zero stops were available, he could set them at 100, 200, 300, 400, and 500 yards, respectively. In practice, for example, a target at 400 yards could be perfectly sighted for the system with five zero stops, whereas the shooter with the three zero stop system would have to set the turret at 300 yards and make manual adjustments to compensate for the remaining 100 yards.

A further limitation of modern riflescopes with multiple zero points, including Menges, is a limited rotational range of the turret, which limits the amount of elevation change available, and to a certain extent, elevation change resolution. The rotational or angular range of a turret may be expressed in "minutes of angle" or MOA, or other angular measurement systems. Rotating the turret adjusts the angular position of the riflescope relative to the rifle barrel. The greater the target distance, the more MOA the turret must be rotated to compensate for the greater amount of bullet drop. The Menges turret has twelve MOA per 360° of rotation of the turret and the turret is limited to one rotation, therefore limiting the range and/or resolution of the turret.

An even further limitation with modern riflescopes, including Menges, is the perceptibility of the indicators. Since each indicator zero point corresponds to a specific rotational angle of the turret, the width of the indicator zero point is limited by the arc length of the MOA resolution, and by the height of the indicator index. Riflescopes such as Menges, and others such as U.S. Pat. No. 6,772,550 to Leatherwood, that use annular indicator indexes necessarily have very small indicator zero points, which may in the form of small colored dots or tabs, because the height of each annular index is limited by the overall turret height and the number of additional indices.

Moreover, existing color coded indicators on turret could be more visible and pronounced. Existing color coding may be a pin viewed from a slot or an arrow positioned partially up the turret. Improvements on such visibility are warranted.

An additional problem with current riflescopes is caused by the myriad distinctions between individual characteristics of ammunition, rifles, and atmospheric conditions. Ammunition and rifles each vary by brand and even by model within a given brand with respect to shot characteristics and manufacturing tolerances. Likewise, atmospheric conditions significantly vary depending on geographic location. For example, rifles used in northern Minnesota are subject to very different atmospheric conditions than those used in Afghanistan. In aggregate, there are countless possible combinations of parameters that have a direct effect on a given rifle's accuracy at various ranges, thereby increasing the complexity of ballistic calculations as well as the time needed to make those calculations.

SUMMARY

An embodiment of the invention includes a riflescope aiming system that can be quickly and easily setup, tested, and tuned to match a bullet's point of impact at various ranges for a specific gun, ammunition, and atmosphere combination.

Another embodiment includes a calculation tool that indicates riflescope elevation and wind hold setup parameters based on shooter-inputted firearm, ammunition, and atmospheric combinations.

Another embodiment of the invention includes a turret having multiple elevation zero-point adjustments, a "multiple-zero-point" elevation turret, that allows a user to easily set indicator markers, such as colored indicator pins, plugs, flags, or numbered markers, or numbered and colored markers for a plurality of elevation zero points based on the output of the calculation tool. Additionally, it is desired that the indicator indices are easily perceptible by maximizing the height dimension of each indicator index as well as the radial extension of the index. Considering the wide variety of ammunition characteristics, manufacturing tolerances, individual rifles and changing atmospheric conditions, there are millions of combinations available to a shooter that have a direct effect on where a bullet will impact at various ranges. Having an adjustment system on a riflescope that can be easily setup, tested and tuned to match where a bullet will impact at various ranges, vastly improves long range hit probability when hunting afield. While other ballistic turrets can only generally predict the flight characteristics of a single ammunition, the multiple-zero-point turret of the invention can be easily changed to match another ammunition or rifle without additional parts, and simply arranged and tuned ahead of a hunt. Such a turret can be removed and stowed when different ammunition is to be used, and then replaced with the ammunition for which it was setup is to be used again. Consistent with this, several turrets can be retained corresponding to different ammunition.

Another embodiment of the invention includes a riflescope turret indicia system having a plurality of colored indicator markers, such as pins, located around a center splined indicator carrier, which is removable from the scope and retained by a gripping cap and screw. Each indicator pin represents a zero point for a given elevation distance. Each of the indicator-pin channels, in an embodiment, represents a specific relative angular position, such as a minute of angle (MOA) position. Although the term MOA is used throughout the present application, it will be understood that unless specified otherwise, MOA refers generally to an angular measurement, and can include alternative metric measurements, such as MilRads.

Another embodiment includes a ballistics reference system coupled to the riflescope or rifle to aid the shooter in easily selecting the right turret stop for multiple known distances, wherein the ballistics reference system includes a printed card or disk that may be automatically generated by the calculation tool for the shooter's given setup. The ballistics reference card is coupled to the rifle with a ballistics reference mounting system that includes a holder or other structure for holding or supporting the reference card. The ballistics reference card may be mounted to the rifle in a variety of locations, including on a rifle scope, on the riflescope mounting hardware, on the rifle stock, on the rifle forestock, and so on.

Another embodiment of the invention includes an electronic tool, such as a ballistics calculator that allows a user to input various parameters of the riflescope setup, rifle, ammunition, and anticipated atmospheric conditions, and automatically provides the indicator carrier angular position, measured in MOA in an embodiment, for each of the plurality of colored indicator pins.

Embodiments of the invention also include a number of methods relating to configuring and using a multiple-zero-point elevation turret, ballistics reference system, and riflescope aiming system.

In one such method, a shooter first estimates the distance to a target, which may include using a laser sight or other distance-measuring means. Next, the shooter moves a ballistic reference card or disk from a stowed position into a viewable position, then refers to the ballistic reference card or disk to determine a color (or other indicia) corresponding to the distance. After that, the shooter rotates an indicator carrier of the multiple-zero-point elevation turret until an indicator pin corresponding to the referenced color (or other indicia) from the card is aligned with a zero indicator on the scope. Next, the shooter aims, correcting for the reticle wind hold. Finally, the shooter fires his rifle at the target. The method may include selecting a specific ballistic reference card form a set or deck of such cards corresponding to a specific ammunition that is going to be fired, for example. In embodiments, the set or deck of cards may be retained together.

In an embodiment of the invention, a riflescope aiming system includes a plurality of cards, the cards unique to specific ammunition or replaceable turret or other changeable parameters associated with rifle shooting. The system includes a card mounting system, for securing the plurality of cards, the mounting system including a card holder, a movement portion, and a rifle and/or scope mounting portion. The movement portion allowing the card holder to move from a viewable position to a stow position. In embodiments, the holder is a containment with an inside region conforming to the card size, the inside region may be sized to hold a plurality or deck of cards, each of the cards having elevation data, indicia reference markings to match indicia reference markings on a scope elevation turret, and may have other data relating to atmospheric conditions such as wind. In embodiments each card may be associated with a specific replaceable rotatable indicator carrier of a elevation turret. In embodiments each card may be associated with a set of indicators positioned on a portion of a rotatable indicator carrier in specific locations correlating to ballistic performance at varying ranges of specific ammunition used in a specific rifle. The card holder may retain a set or deck of card where a selected on may be moved to the first card in the set or deck that is then viewable from the deck.

A feature and advantage of particular embodiments of the invention is that a ballistic reference card mounting system conveniently attaches to the firearm and is movable from a stowed position to a viewable position. The reference mounting system may comprise a mounting portion, a movement portion, and a reference card holder. The mounting portion may comprise one or more rings, straps, frames, fasteners and so on for mounting the reference card holder and movement portion to the firearm, including on the scope. The movement portion can be a hinge or other flexible mechanism to allow pivoting of the card holder between the stowed position and the viewable position. The viewable position allows a user when positioned in a shooting position behind the scope, to be able to view the ballistics reference card with no or minimal movement from the shooting position behind the scope. The reference card holder may be readily graspable to move from the stowed position to the viewable position when the user is in the shooting position with the head and eye behind the scope. The viewable position being in an automatic set repeating position by way of detents, springs or the like such that adjustment of the position is not necessary. The stowed position such that the reference card holder minimizes or does not impede transport or general handling of the rifle. The reference card holder may provide a weather-tight containment of the ballistics reference card and may have sufficient room to store several such ballistic reference cards. The reference card holder may have a transparent lens as part of an openable containment or the ballistics reference cards may be coated with transparent coating such as a polymer to be weather proof. The several ballistics reference cards may each individually correspond to a particular ammunition type usable in the rifle. The ballistics cards sized and matching an interior dimension of the container. Additionally, different cards may correlate to different turrets. In embodiments the viewing position is defined as to when the rifle user has his shooting eye to the scope and the non-shooting eye can view the card holder without moving the user's head or with minimal movement. In embodiments, the viewing position of the reference card holder is on the left side of the scope, in embodiments left or right of the scope and attached at the forward end of the scope, in embodiments at the forward end of the rifle forestock.

In embodiments, the reference mounting system may attach to the firearm in proximity to where the firearm user supports the firearm with his forward hand, close so that the switching of the mount from the stowed position to the viewable position, and back, can be accomplished with little movement of the gun, and if desired, without taking the users eye off of the target, and preferably without any significant body or head or arm movement.

Another embodiment includes a ballistics reference system coupled to a riflescope or rifle and comprising a deck of cards, with at least two cards, each correlating to a specific field replaceable rotatable indicia portion of an elevation turret or correlating to a specific ammunition for the rifle. In embodiments, the system includes a mounting portion and a holder portion for the deck of cards to the rifle or riflescope to aid the shooter in easily selecting the right turret stop for multiple known distances. In embodiments, the ballistics reference system includes a printed card or disk that is automatically generated by the calculation tool for the shooter's given setup. In embodiments, the deck of reference cards is coupled to the rifle with a mounting system that includes a holder or other structure for holding or supporting the reference card. The ballistics reference card may be mounted to the rifle in a variety of locations, including on a rifle scope, on the riflescope mounting hardware, on the rifle stock, on the rifle forestock, and so on. In embodiments, the holder is attached to a movable portion, such as a hinge, and the movable portion is attached to the rifle or riflescope by bands, clamps, fasteners, or other attachment means.

A feature and advantage of embodiments are colored indicator markers that are viewable from approximately 180 degrees. Such colored markers are placed outside the perimeter of the cylindrical portion of the turret and extend substantially or the entire length of the cylindrical portion of the turret below a gripping portion.

In embodiments, a gripping cap is part of the rotatable turret, with a cylindrical portion therebelow that includes removable markers or indicia. In that such markers or indicia may be prone to breakage or falling out of there precise locations, the gripping cap may be oversized diametrically by at least 17% over the cylindrical portion that receives markers. In other embodiments, at least 19% bigger diametrically. This provides protection by an overhang and intuitive gripping surface minimizing the chance of the user grabbing the cylindrical portion with removable indicia when adjusting the turret possible damaging or dislodging same.

In embodiments of the invention, the markers on the cylindrical portion below the gripping cap may be elastomeric plugs or stretchable bands that attach to openings or protrusions on the cylindrical portion. In embodiments, the markers may be threaded plugs or rigid strips that attach with fastening portion, for example screws, to the cylindrical portion. Advantageously, the elastomeric markers may be attached without tools and without removing the turret cap. In embodiments, a protective transparent shield may be attached over the cylindrical portion with markers attached to secure and protect the integrity of the positioning of the markers. In embodiments, the transparent shield may be a short tubular thin walled piece of polycarbonate, in embodiments with a slit for snapping over the cylindrical portion with markers therein. The tubular portion may have an inside diameter slightly larger than the outside diameter of the cylindrical portion receiving the markers whereby the markers, in embodiments, maybe partially sandwiched between the outside cylindrical surface and the transparent shield.

In embodiments of the invention include indicator carrier for a turret with multiple attachment positions for indicator markers, a plurality of indicator markers with coloring or indicia (such as yardage markers), a holding system for cards, and instructions for calculating or downloading data and/or images for indicia cards that may be used with a turret for particular ammunition. The indicia cards may for example, have a plurality of color indicators listing in a column, and the yardage associated with the indicators in a corresponding column, it may also have the minutes of angle adjustment of the turret between the stated yardages in another column. For a particular card may be correlated to a particular elevation turret indicator the colors may be associated with incremental distances such as yellow 100 yds, blue 150 yds, green 200 yds, purple 250 yds, white 300 yds, brown 350 yds, indigo 400 yds. The turret indicator may have positions of the indicator markers preset, or the position of a first distance may be determined by the user and the additional positions provided by instructions and/or a ballistic calculator, such as downloading same. The positions identified by the incremental minutes of angle scale (MOA) on the indicator carrier. In an embodiment, another card may be associated with the same turret and the same colors with different yardages yellow 110 yds, blue 165 yds, green 215 yds, purple 270 yds, white 325 yds, brown 380 yds, indigo 400 yds as provided by the download and/or ballistic calculator. In embodiments, specific cards with color coded distances may be provided and data may be downloaded for locating the colored markers at specific incremental positions as indicated by the minutes of angle indicators (MOA) on the indicator carrier. In embodiments, the above may be sold as a kit including instructions for setting up the elevation turret with the indicator carrier and the indicator markers. In embodiments, the kit can include a riflescope with an elevation turret conforming to the indicator carrier. Kits may include packaging for the contents and instructions for use, install, and downloading images and data for the cards.

In embodiments, removable markers are provided to a rotatable cylinder of an elevation turret, In an embodiment, the claimed invention comprises a riflescope aiming system that includes: a telescopic sight including a cylindrical body having an ocular housing carrying an ocular lens system at a first end and an objective housing carrying an objective lens system at a second end, and housing an erector assembly having an erector tube and a reticle; a multiple-zero-point elevation turret mounted to the cylindrical body and operably coupled to the erector assembly, the multiple-zero-point elevation turret including a rotatable indicator carrier and a plurality of indicator pins secured to the indicator carrier, each indicator pin corresponding to a predetermined target distance, the adjustable indicator carrier coupled to the erector assembly such that a rotation of the indicator carrier causes a reticle position to be adjusted; an aiming reference system operably coupled to the objective housing and displaying aiming reference data, the aiming reference data including a target distance and an indicator pin identifier identifying the one of the plurality of indicator pins corresponding to the target distance.

An embodiment of a multiple-zero-point elevation turret for a riflescope comprises: an indicator carrier configured to be rotatably coupled to the riflescope, the indicator carrier defining a plurality of axially extending indicator-pin channels distributed about a circumference of the indicator carrier; and a plurality of indicator pins, each indicator pin corresponding to a predetermined target distance and including a key portion and a visual index portion, each key portion being received by an indicator pin channel such that the indicator pin is secured to the indicator carrier, and the visual index portion presents an index surface. The alignment of the indicator pin with a stationary zero-index mark indicates that the riflescope aiming is adjusted to correspond to the predetermined target distance.

An embodiment of an aiming reference system for a riflescope comprises: a reference disk operably coupled to the riflescope and movable between a first position and a second position; reference data indicia displayed on a surface of the reference disk, the reference data including a plurality of distance indicia, the distance indicia indicating a target distance and a unique identifier corresponding to a zero-point setting of an elevation turret. The reference data indicia are viewable in the first position.

An embodiment of an indexed reticle pattern for a riflescope comprises: a scaled horizontal cross hair having a plurality of evenly spaced stadia markings, the cross hair having a known, uniform width defined in minutes of angle (MOA), each stadia marking having a known, uniform width and height, and a distance between stadia markings being uniform, each of the width, height, and distance measured in minutes of angle (MOA); and a scaled vertical cross hair intersecting the scaled horizontal cross hair and having a plurality of evenly spaced stadia markings, the cross hair having a known, uniform width defined in minutes of angle (MOA), each stadia marking having a known, uniform width and height, and a distance between stadia markings being uniform, each of the width, height, and distance measured in minutes of angle (MOA). The stadia markings provide a reference index for adjusting an optical center of the riflescope.

An embodiment of a method of aiming a riflescope having a multiple-zero-point elevation turret comprises: estimating a distance to a target; viewing a ballistics reference disk coupled to the riflescope, including viewing a plurality of reference distances and a plurality of unique identifiers associated with the plurality of references distances; matching the estimated distance to the target to one of the plurality of reference distances and a unique identifier associated with the reference distance; adjusting a setting of the multiple-zero-point elevation turret based on the unique identifier; and viewing the target through the riflescope.

BRIEF DESCRIPTION OF THE DRAWINGS

The invention can be completely understood inconsideration of the following detailed description of various embodiments of the invention in connection with the accompanying drawings, in which.

Figure 1:
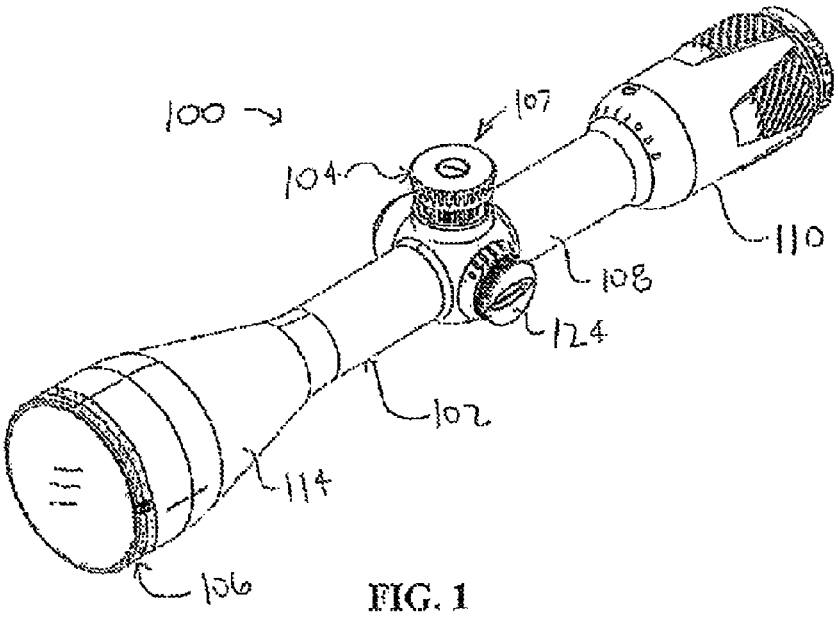
FIG. 1 is front, perspective view of a riflescope aiming system, according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Embodiments of the claimed invention described herein generally include an ergonomic, easy-to-use riflescope aiming system ideally suited for mid- to long-range shooting. In an embodiment, the riflescope aiming system includes an adjustable, multiple-zero-point elevation turret having highly visible zero-point indicators for multiple distances, which in an embodiment may be color coded for quick reference. Additional embodiments of the claimed invention also include a ballistics reference system providing multiple distance and windage data sets corresponding to the multiple-zero-point elevation turret system and corresponding to an indexed wind-hold reticle. The aiming reference system allows a shooter to very quickly make elevation and windage determinations and adjustments in the field.

Referring to FIGS. 1-4, riflescope aiming system 100, according to an embodiment of the claimed invention, comprises telescopic sight or riflescope 102, multiple-zero-point elevation turret 104 and ballistics reference system 106. Together, multiple-zero-point elevation turret 104 and ballistics reference system 106 form riflescope aiming system 100. Riflescope system 100 is described herein in the context of usage with rifles. It will be understood, however, that riflescope system 100 may be used individually or in combination with other firearms, including shotguns, handguns, bows, or various other types of firearms and weapons.

Riflescope 102 includes generally cylindrical body 108, ocular housing 110 carrying ocular lens system 112, objective housing 114 carrying an objective lens system 116, and erector assembly 118 with reticle cell 120 having reticle pattern 122 (see also FIG. 33), and held in place by opposing turret screw 119 and erector spring 123. In an embodiment, telescopic sight 102 may also include windage adjustment turret 124.

Ocular housing 110 is positioned at a first end of cylindrical body 108, while objective housing 114 is positioned at a second end of cylindrical body 108.

Multiple-zero-point elevation turret 104 is mounted to cylindrical body 108 and is rotatable about axis A. Multiple-zero-point elevation turret 104 is described in further detail below.

Ballistics reference system 106, in an embodiment, is coupled to objective housing 141. In an embodiment, ballistics reference system 106 comprises an indicating portion, such as a reference card, sheet, disk, or similar, having printed indicia, and connected to objective housing 114. Ballistics reference system 106 is described in further detail below.

The details of standard optical lens systems of telescopic sights for firearms are generally well known in the art, having been described in many patents, including patents such as U.S. Pat. No. 4,806,007, Issued Feb. 21, 1989 and entitled OPTICAL GUN SITE, and U.S. Pat. No. 7,913,440, issued Mar. 29, 2011, and entitled TELESCOPIC SIGHT, U.S. Pat. No. 8,286,383, both of which are herein incorporated by reference in their entireties. As such standard optical systems and features of telescopic sights are generally well known, such features will not be discussed in detail herein.

Figure 3:
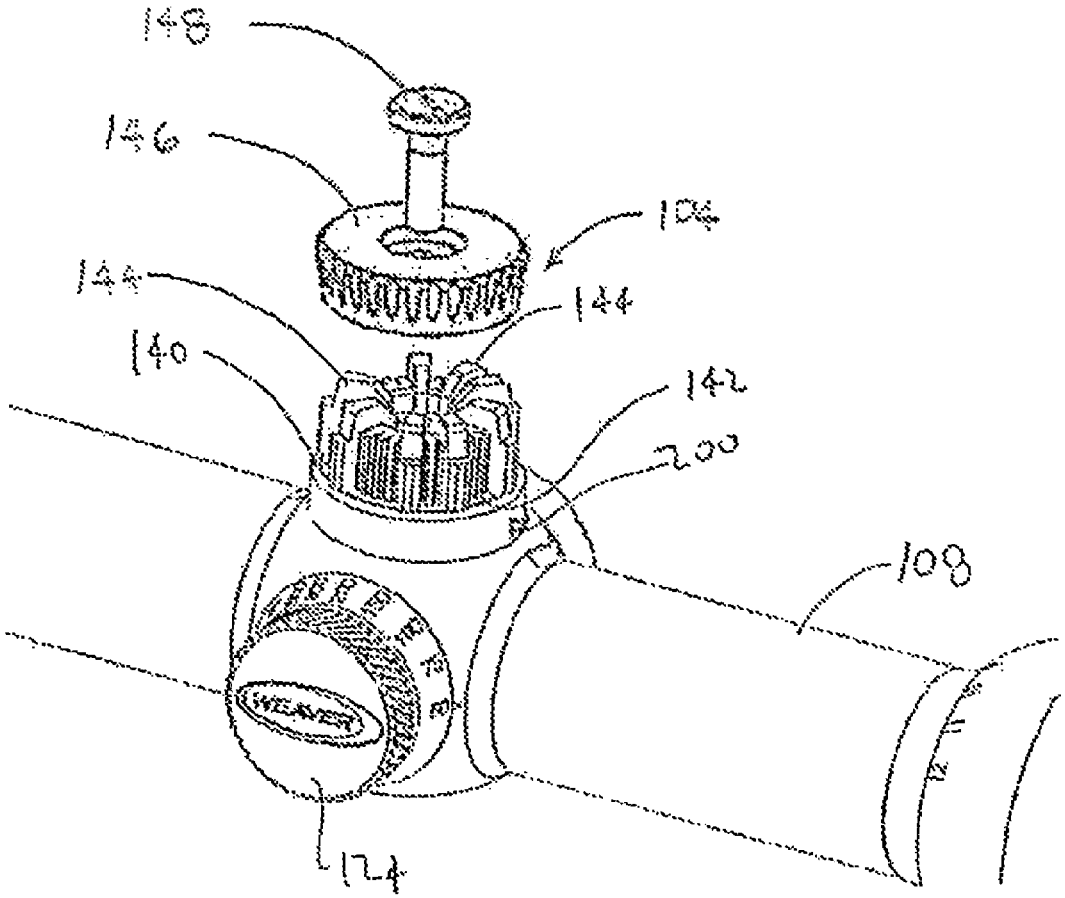
FIG. 3 is a right-side perspective view of the riflescope aiming system of FIG. 1, depicting a multiple-zero-point elevation turret in a partially-exploded view, according to an embodiment of the invention.

Referring to FIG. 3, multiple-zero-point elevation turret 104, according to an embodiment, generally comprises a turret base 140 fixably coupled to cylindrical body 108 of telescopic sight 102, an indicator carrier 142, a plurality of indicator markers 144, which in an embodiment may comprise pins, cap 146, and cap fastener 148.

According to an embodiment, each of the components of the multiple-zero-point elevation turret 104 may be constructed of a machined metal, such as aluminum, steel, or various alloys, or alternatively, a cast metal or an injection molded polymer. Furthermore, the components could be anodized or otherwise coated to provide enhanced durability. The components of multiple-zero-point elevation turret 104, according to an embodiment, may further include various features or surface treatments to ease assembly. For example, the outer circumference of gripping cap 146 may be knurled to provide better grip while being screwed down.

Figure 4:
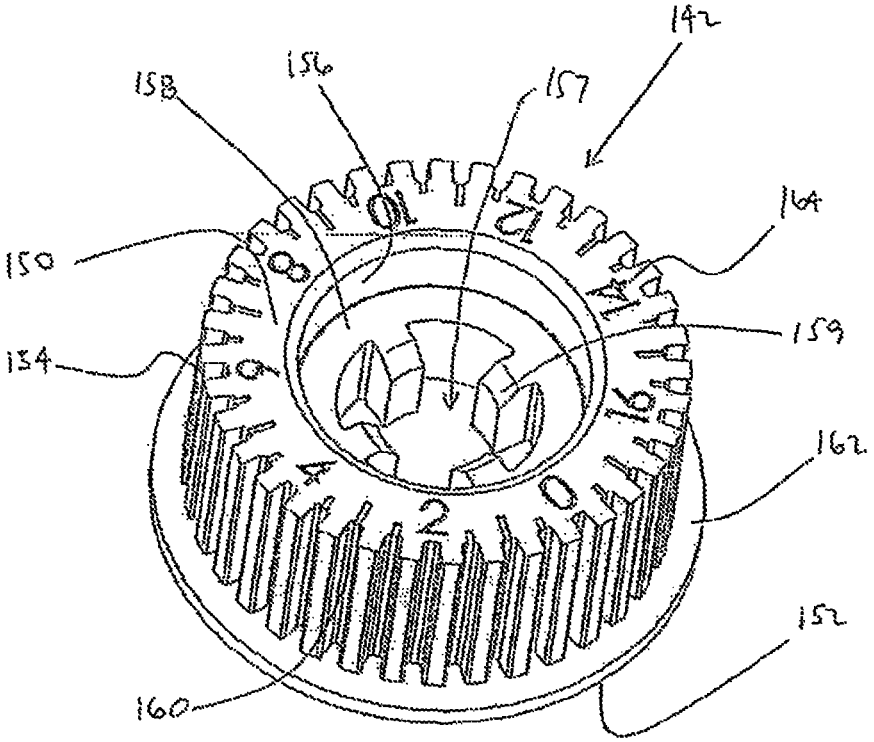
FIG. 4 is a perspective view of an indicator carrier of the multiple-zero-point elevation turret of FIG. 3, according to an embodiment of the invention.
Figure 5:
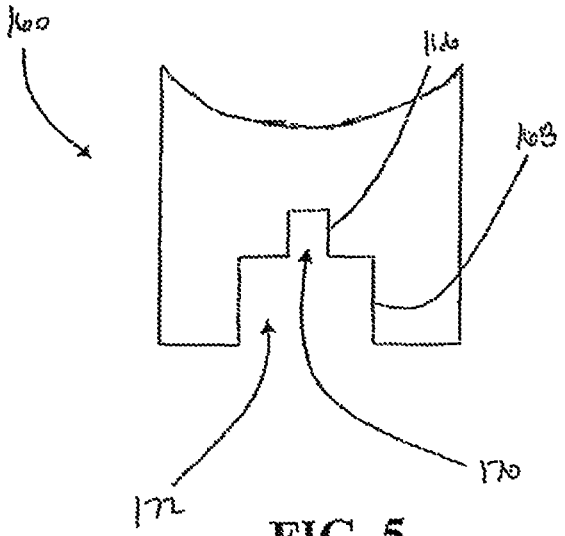
FIG. 5 is a top view of a portion of the indicator carrier of FIG. 4, depicting an indicator-pin channel, according to an embodiment of the invention.

Referring also to FIGS. 4-5 an embodiment of indicator carrier 142 is depicted. In an embodiment, indicator carrier 142 is substantially cylindrical, and includes top surface 150, bottom surface 152, outer surface 154 and inner surface 156. In an embodiment, inner surface 156 defines central aperture 157. Projections 159 protrude radially inward toward the center of carrier 142, such that central aperture 157 comprises a splined aperture. In an embodiment, central aperture 157 is configured to engage with an end of turret screw 119 projecting axially upward through central aperture 157.

In an embodiment, a plurality of indicator-pin channels 160 are spaced evenly about the outer circumference of indicator carrier 142 and extend radially inward from the outer surface 154, and axially downward from surface 150. In other embodiments, indicator carrier 142 may not include indicator-pin channels 160, but rather, may include other means for coupling pins 144 at distal and proximal ends to indicator carrier 142. Base 162 extends radially from bottom surface 152 of indicator carrier 142, extending slightly past the outer edge of the wide walls 168 of the indicator-pin channels 160 and creating a flange.

Referring specifically to FIG. 5, a portion of indicator carrier 142 defining indicator-pin channel 160, as shown from a top view, according to an embodiment of the invention, is depicted and described in further detail.

Each of the plurality of indicator-pin channels 160 is configured to receive any one of the plurality of indicator markers or pins 144. Indicator-pin channel 160 includes narrow walls 166 and wide walls 168, which define a narrow slot 170 and a wide slot 62, respectively. The narrow slot 60 and wide slot 172 engage with complementary features on an indicator pin 144, to retain the pin. Each of the narrow slots 170 correspond to a respective angular position and angular position indicia 164, which may be measured in MOA, on indicator carrier 142.

Referring again to FIG. 4, in an embodiment, a plurality of angular position indicia 164 are disposed circumferentially on top surface 150 of the indicator carrier 142. In other embodiments, such angular position indicia 164 may not be present, or may be present on a separate disk, label, or other part attached to indicator carrier 142, as described in an alternate embodiment below (see FIGS. 8-13). Each angular position indicia 164 is aligned with a narrow slot 170 of an indicator-pin channel 160. The angular position indicia 164 can be machined, etched, painted, or otherwise affixed to the indicator carrier 142. When an indicator pin 144 is seated in an indicator-pin channel 160 of the indicator carrier 142, the center of the indicator pin 144 is aligned with the center of its indicator-pin channel 160, and therefore is aligned with the center of that particular angular or MOA position.

In an embodiment, the angular resolution of indicator carrier 142 is dictated by the number of indicator-pin channels 160 on the indicator carrier 142. In an embodiment, for each indicator carrier 142, a complete 360° rotation corresponds to a given angular measurement value, which may be measured in minutes of angle, which in this example embodiment is 18 MOA. Depending on the number of indicator-pin channels 160, each channel can represent one MOA, or a fraction or multiple thereof. In the example embodiment, each indicator-pin channel 160 represents 0.5 MOA.

Figure 6:
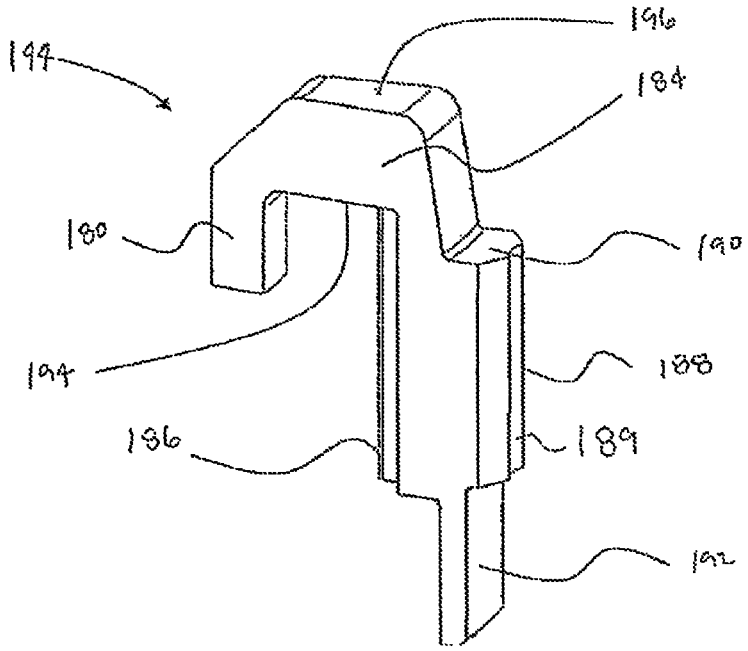
FIG. 6 is a perspective view of an indicator pin, according to an embodiment of the invention.
Figure 7:
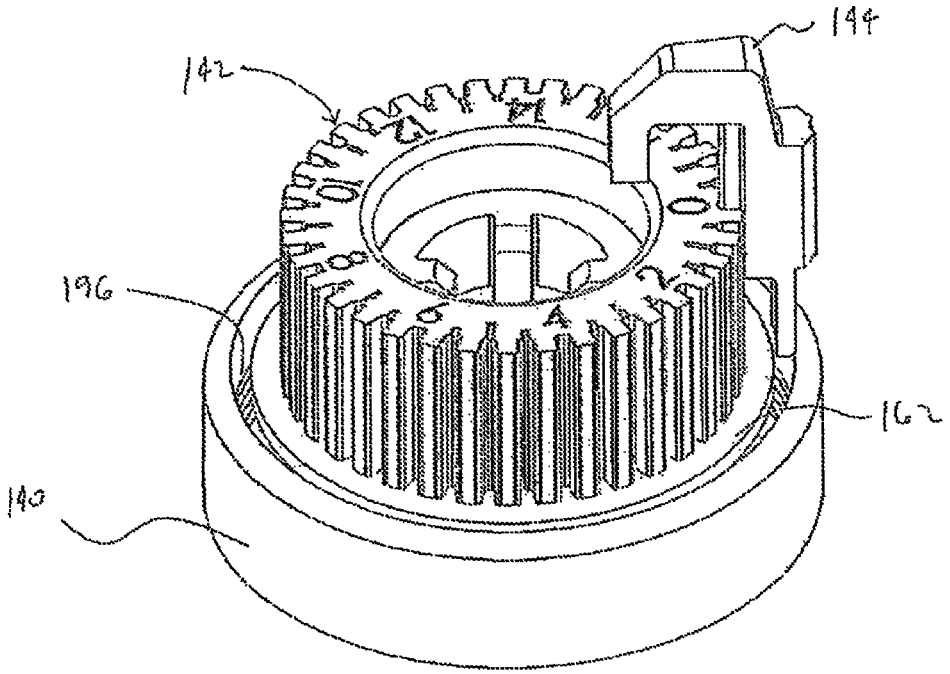
FIG. 7 is a perspective view of an indicator pin positioned on the indicator carrier, according to an embodiment of the invention.

Referring now to FIG. 6, an indicator marker or indicator pin 144, according to an embodiment of the invention, is depicted. Indicator marker or pin 144, according to an embodiment, comprises a unitary body generally shaped like an upside down letter "J". Indicator pin 144 has inner hook section 180, outer leg section 182, and top neck section 184 that connects inner hook section 180 to outer leg section 182. Inner hook section 180 and outer leg section 182 define inner and outer directions for the purposes of describing indicator pin 144. The width of indicator pin 144 converges, with the width at its outer-most section being thickest to the width at its inner-most section being thinnest, such that multiple indicator pins 144 can be placed adjacent each other on the indicator carrier 142.

Extending inwards from the outer leg section 182 is the pin key section 186, which correspondingly fits into a pin channel 160 of the indicator carrier 142. Extending outward from the central portion of outer leg section 182 is the visual index portion 188, which presents index surface 189 which is visible to a user. In an embodiment, visual index portion 188 is easily visible to a user because it is the widest section of the indicator pin 144. The top of the visual index portion 188 defines a retaining shelf 190, which gripping cap 146 depresses. Opposite shelf 190 at the bottom-most portion of outer leg section 182 is finger section 192, which slidably engages with channel 196, which is defined by indicator carrier base 162 and turret base 140.

Top neck section 184 includes bottom face 194, which slidably engages with top surface 150 of indicator carrier 142, and top face 196, which gripping cap 146 depresses. Furthermore, in an embodiment, the edges of the visual index portion 188 may be chamfered and the center indented, making it easy to determine the center of the pin to ensure that it is properly aligned with zero indicator 200 of FIG. 3 during operation.

Referring also to FIG. 3, indicator carrier 142 with multiple indicator pins 144 is depicted as received by turret base 140. As will be described further below, each indicator pin 144 when properly located, corresponds to a predetermined target distance and distance zero point (point at which the firearm is sighted in for that distance such that aligning the crosshairs on the target results in the bullet striking the target).

Figure 2:
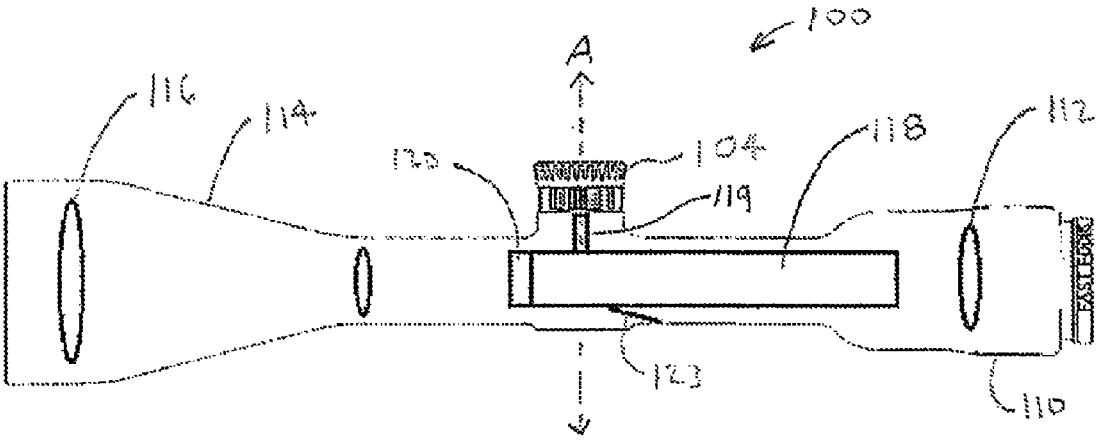
FIG. 2 is a right-side view of the riflescope aiming system of FIG. 1.

In an embodiment, turret base 140 includes a shallow recess configured to receive base 162 of indicator carrier 142. In an embodiment, turret base 140 also includes an aperture generally coaxial with aperture 157 of indicator carrier 142. In an embodiment, telescopic sight 102 includes turret screw 119 having a distal end operably connected to erector assembly 118 (see also FIG. 2) and a proximal end projecting through the aperture defined by turret base 140 and being operably connected to indicator carrier 142. In an embodiment, the proximal end of turret screw 119 has an end that in a cross sectional view is complementary to splined aperture 157, such that the turret screw and carrier are tightly coupled. The turret screw may be generally aligned along Axis A, as indicated in FIG. 2.

When initially assembled, indicator carrier 142 is positioned onto the proximal end of turret screw 119 such that the "0" indicia of angular position indicia 164 is positioned adjacent zero-point indicator or zero indicator 200. Zero indicator 200 may be located on cylindrical body 108 or on turret base 140. Indicator pins 144 may be placed into channels 160 of indicator carrier 142 as described above. Cap 146 is fastened onto carrier 142.

In general operation, rotation of cap 146 causes rotation of indicator carrier 142, which consequently turns turret screw 119, which causes erector assembly to adjust reticle cell 120 and its pattern upwardly or downwardly within cylindrical body 108.

The rotation of an elevation turret operably coupled to an erector assembly via a turret screw to cause a reticle to be adjusted is well-known in the art. Examples of apparatuses and methods relating to elevation adjustment turrets include: U.S. Pat. No. 3,990,155 issued Nov. 9, 1976, and entitled RIFLESCOPE ELEVATION ADJUSTMENT ASSEMBLY; U.S. Pat. No. 5,715,607, issued Feb. 10, 1998, and entitled TELESCOPIC SIGHT; U.S. Pat. No. 8,286,383, issued Oct. 16, 2012, and entitled RIFLE SCOPE AND ALIGNING DEVICE; and US Pat. Pub. US 2008/0289239, published Nov. 27, 2008, and entitled ACTUATOR FOR SETTING AT LEAST ONE OPTICAL PROPERTY, all of which are incorporated by reference herein in their entireties.

An embodiment of the claimed invention also includes a method of calibrating, configuring or initializing multiple-zero-point elevation turret 104. At a first step, an initial zero-point, corresponding to a first and minimum distance is determined and set. Indicator carrier 142 is placed onto turret screw 119 with the "0" angular position indicia aligned with zero indicator 200 on cylindrical tube 108 (or turret base 140). The firearm is then sighted in for a predetermined distance by incrementally rotating indicator carrier 142 until the adjustment results in the fired projectile strikes the intended target when the reticle is placed over an image of the target as seen through the ocular. At this point, the zero angular position indicia is likely not aligned with zero indicator 200.

Indicator carrier 142 is then removed from turret screw 119 and turret base 140, rotated such that the zero angular position indicia 164 on carrier 142 is aligned with zero indicator 200, and then is placed back onto turret screw 119 and into base 140. At that particular adjustment position, the first and zero point, the firearm is sighted in for that particular predetermined distance. A first indicator pin may then be placed into a channel 160 corresponding to the zero angular position indicia 164 on top surface 150 of carrier 142. For example, a first indicator pin may be placed at the zero indicia for a predetermined distance of 200 yards, or 300 yards. Typically the first indicator pin corresponds to a minimum predetermined distance. The position of the first pin 144 aligned to the zero mark may be considered a first "zero stop" or zero point.

In an embodiment, each indicator pin 144 may be colored, and each pin may have a unique color corresponding to one of a plurality of predetermined distances. In this manner, each pin corresponds to one predetermined distance. Further, additional pins 144 are inserted into additional channels 160, indicating additional distances, and thusly creating a "multiple-zero-point" elevation turret, each distance having a zero-point corresponding to a pin 144 (and an angular position indicia 164).

In an embodiment, the appropriate channel 160 for each additional pin 144 for a predetermined distance may be determined by trial and error, e.g., by firing and adjusting the rotational position. In one such embodiment, after determining the first zero point corresponding to the minimum of the predetermined distance, a user fires the rifle at a target positioned at a second distance, the second distance being greater than the first, minimum distance. The position of turret 104 is adjusted by rotating turret 104 such that the first pin 144 and corresponding "zero" angular position indicia 164 are no longer aligned with zero indicator 200. After firing the rifle, turret 104 may be further rotated until the rifle and scope are sighted in, i.e., the point at which placing the crosshairs of the reticle on the target and firing the rifle results in the bullet hitting the target. At the sighted-in rotational position, one of a non-zero angular measurement indicia 164 (e.g., "2" or "4", etc.) as well as a pin channel 160, will align with zero indicator 200. An indicator pin 144 is then placed into the pin channel 160, such that the selected indicator pin 144 and the non-zero angular position indicia 164 now correspond to the second predetermined target distance.

The trial-and-error sighting-in process may be repeated to determine indicator pin 144 placement on indicator carrier 142 for additional target distances. Eventually, indicator carrier 142 will have multiple indicator pins 144 placed about indicator carrier 142, each corresponding to a target distance.

In an alternate embodiment for locating indicator pins 144 onto indicator carrier 142, a ballistics calculator may be used. As will be explained further below, a ballistics calculator receives ballistics data from a user, such as ammunition type, rifle or firearm type, and possibly other atmospheric or environmental information. The output of the ballistics calculator may include information used to define pin placement. In one such embodiment, the provided information may include angular position or measurement data, such as minutes-of-angle or milirads, between desired target distances. For example, for a particular rifle and ammunition combination, a first predetermined target distance corresponding to a first zero point may be at 200 yards. In this case, turret 104 and the rifle are sighted in at 200 yards, and a first indicator pin 144 and zero indicia 164 are aligned with zero indicator 200.

Next, rather than sight the rifle in at the second target distance, information from the ballistics calculator may be used to determine the placement of the other indicator pins 144. In an embodiment, a second distance and corresponding second indicator pin 144 may correspond to a predetermined angular position indicia 164. In the example, the second distance may correspond to 200 yards, a red pin 144, and an indicia 164 of "2". As such, red pin 144 may be placed in the pin channel 160 adjacent, or corresponding to, the angular position indicia 164 labeled "2". Third, fourth, and subsequent indicator pins 144 may likewise be located on indicator carrier 142 based on angular position data, which may be defined in MOA or by other angular measurement systems, and provided by a ballistics calculator.

A benefit of using a ballistics calculator in this manner is that the rifle need only be sighted in at a first distance, and need not be sighted in manually, or via trial-and-error, for every distance desired. The use of a ballistics calculator in conjunction with system 100 will be described further below.

Referring to FIGS. 8-13, an alternate embodiment of a multiple-zero-point elevation turret, turret 300 is depicted. Multiple-zero-point elevation turret 300 is generally similar to multiple-zero-point elevation turret 104 described above. As will be described further below, as compared to turret 104, turret 300 includes some additional structural and functional features relating to turret indexing and limited rotation.

Figure 8:
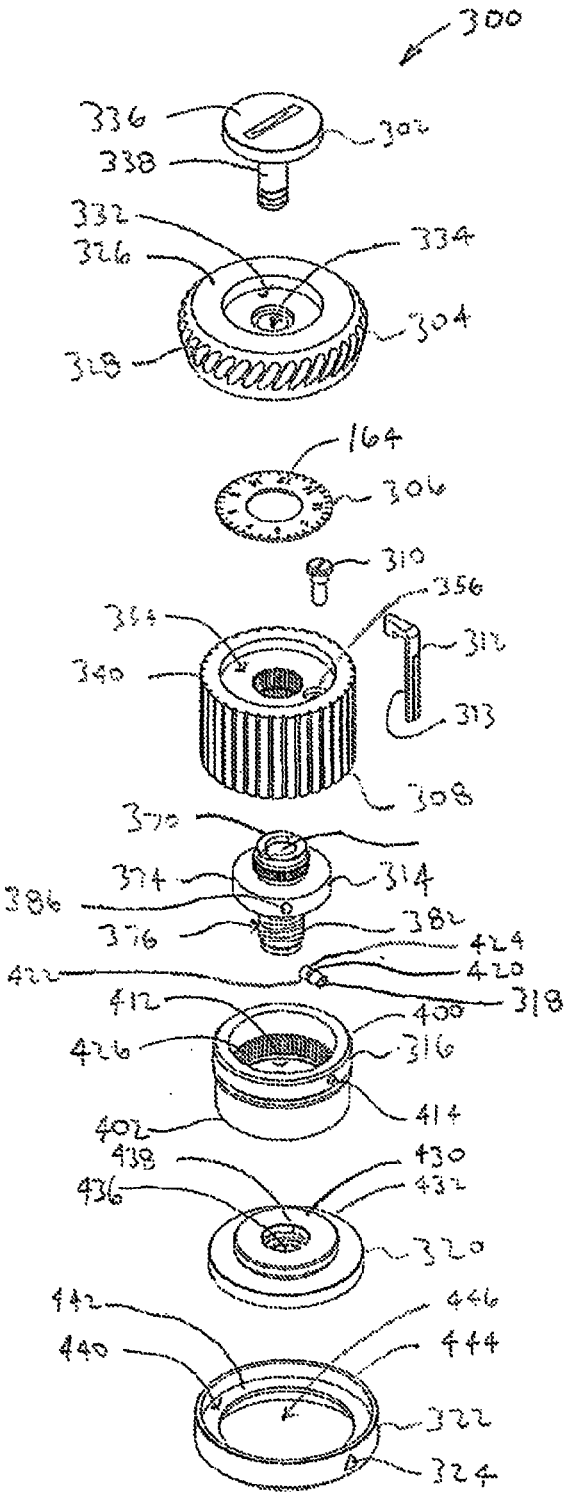
FIG. 8 is an exploded view of a multiple-zero-point elevation turret, according to an alternate embodiment of the invention.

Referring specifically to FIG. 8, in an embodiment, multiple-zero-point elevation turret 300 includes cap fastener 302, cap 304, angular position indicia disk 306 with angular position indicia 307, indicator-pin carrier 308 carrying multiple indicator pins 312 and vertical stop node 310, turret screw assembly 314, turret collar 316 with horizontal stop node 318, seat assembly 320, and turret ring 322 with zero indicator 324.

Figure 9:
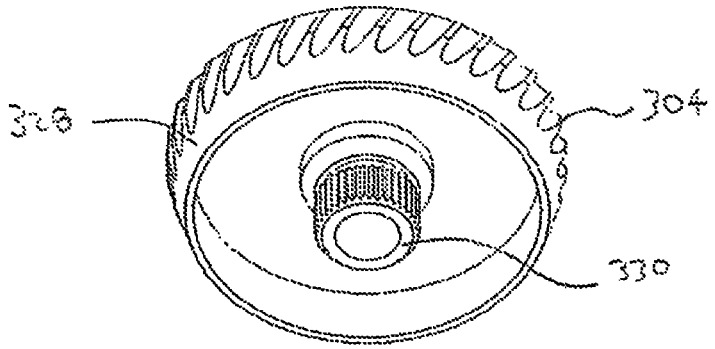
FIG. 9 is a bottom perspective view of a cap of the turret of FIG. 8, according to an embodiment of the invention.

Referring also to FIG. 9, in an embodiment, cap 304 includes top portion 326, circumferential lip portion 328, and shaft 330. Top portion 326 defines fastener recess 332 and fastener opening 334. Fastener recess 328 is configured to receive head portion 336 of fastener 302, while fastener opening 332 is configured to receive shaft portion 338 of cap fastener 302.

Lip portion 328 extends about a periphery of cap 304, extending axially downward and away from top portion 326. In an embodiment, lip portion 328 includes structure, such as ribs and slots as depicted, for gripping by a user.

Shaft portion 330 extends axially downward from a central portion of top portion 326, defining fastener opening 334. Shaft portion 330 may be splined as depicted, and configured to be received by indicator carrier 308, thereby securing cap 304 to indicator carrier 308, as described further below.

In some embodiments, multiple-zero-point elevation turret 300 includes indicia disk 306. In one such embodiment, indicia disk 306 is not integral to indicator carrier 308, but rather comprises a distinct and separate structure that couples to, or resides on, indicator carrier 308. Indicia disk 306 includes and depicts angular position indicia 164, such as MOA indicia, that correspond to incremental, rotational movements of indicator carrier 308 and turret screw assembly 314. In the depicted embodiment, indicia disc 306 depicts 16 MOA, indicating that turret 300 may be rotated approximately 16 MOA with one 360° rotation.

Figure 10:
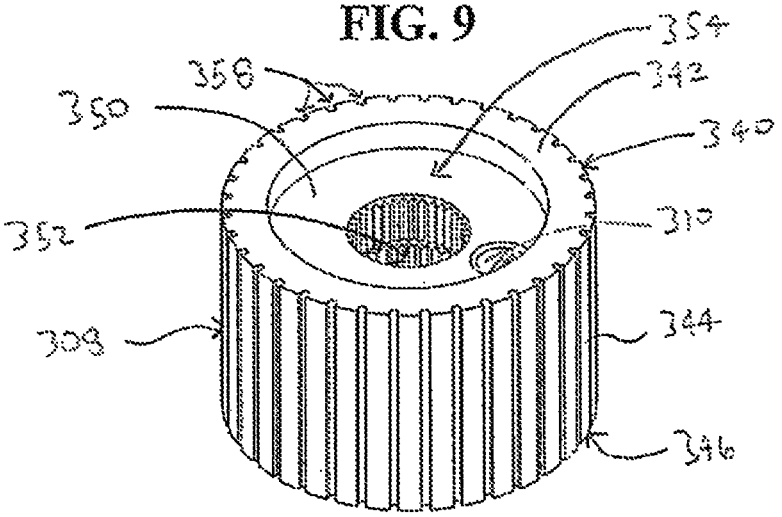
FIG. 10 is a top perspective view of an indicator carrier of the turret of FIG. 8.
Figure 11:
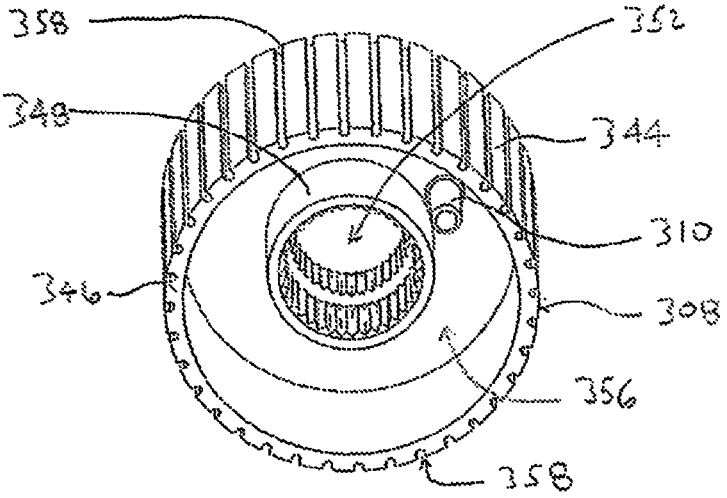
FIG. 11 is a bottom perspective view of the indicator carrier of FIG. 10.

Referring to FIGS. 10 and 11, an embodiment of indicator carrier 308 is depicted. In this depicted embodiment, indicator carrier 308 includes top portion 340, including rim portion 342, perimeter wall 344, bottom portion 346, and central portion 348. Indicator carrier 308 may comprise any of a variety of generally-rigid materials, including aluminum, steel, plastic, and so on.

Top portion 340 forms a generally planar portion 350 defining central aperture 352. Rim portion 342 extends circumferentially about top portion 340. Top portion 340 defines top recess 354 configured to receive disk 306 and portions of pins 312.

Referring also to FIG. 8, top portion 340 also defines vertical stop node receiver 356. Vertical stop node receiver 356 in an embodiment comprises a through-hole in planar portion 350, and is configured to securely receive vertical stop node 310. In an embodiment, vertical stop node 310 comprises a flanged pin that may be pressed into receiver 356, such that vertical stop node 310 extends downwardly and away from portion 350, and is securely held in place. In other embodiments, vertical stop node 310 may comprise a screw or another similar projection that may comprise a distinct and separate component coupled to indicator carrier 308, or may comprise a projecting structure integrated into indicator carrier 308. As will be discussed further below, vertical stop node 310 interacts with horizontal stop node 318 to limit rotation of indicator carrier 308 to less than one full rotation, or just less than 360° rotation.

Central portion 348 comprises a generally cylindrical projecting portion defining central aperture 352. Central aperture 352 is configured to receive cap shaft 330 at a top portion and as will be described further below, a top portion of turret assembly 314. In an embodiment, central aperture 352 defines a generally cylindrical opening. An inside surface of central portion 348 may include structure to axially receive cap shaft 330 and turret screw assembly 314, while rotationally securing shaft 330 and assembly 314. In an embodiment an inside surface of central portion 348 includes a plurality of longitudinal or axially-extending ridges or splines.

In an embodiment, perimeter wall 344 defines collar-receiving cavity 356 at an interior of indicator carrier 308, and defines a plurality of indicator-pin channels 358. Indicator-pin channels 358, in an embodiment, extend from top portion 340 axially downward toward bottom portion 346. In an embodiment, channels 358 may be evenly distributed about perimeter wall 344. In an embodiment, channels 352 define an inwardly extending groove defining a channel shape. The channel shape may be semi-circular in cross section, or may define other shapes, such as a V shape, or other shape configured to receive a portion of a pin 312.

Indicator pins 312 may be substantially similar to pins 144 described above, configured to couple to indicator carrier 308. Pin key sections 313 of pins 312 may be configured to be received by indicator-pin channels 358. In an embodiment, pins 312 are initially loosely fit onto indicator carrier 308, then held in place via cap 304.

Figure 12:
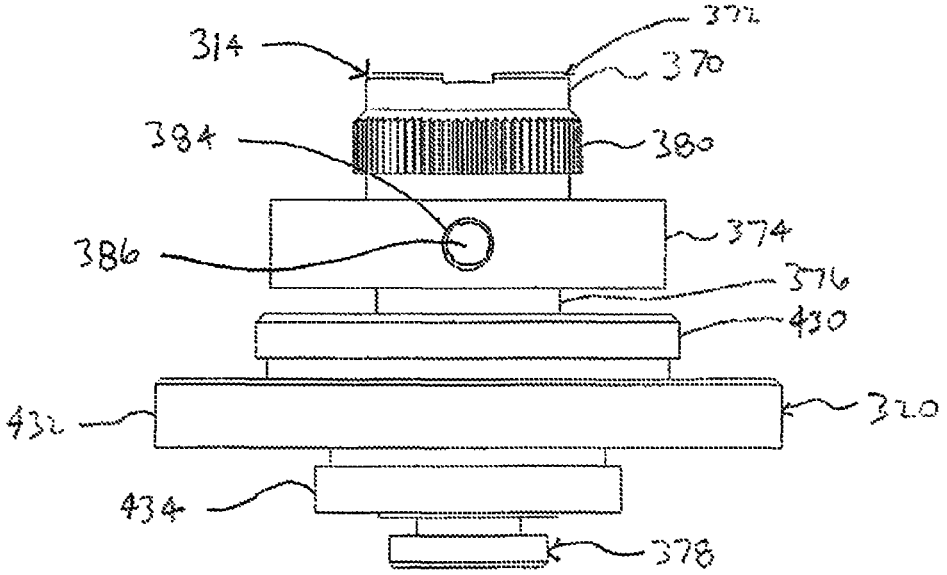
FIG. 12 is a front view of a turret screw assembly coupled to a seat assembly of the turret of FIG. 8.

Referring to FIG. 8 depicting turret screw assembly 314, and to FIG. 12, depicting turret screw assembly 314 coupled to seat assembly 320, in an embodiment, turret screw assembly 314 includes head portion 370 at proximal end 372, indexing base 374, shaft 376, and distal end 378. In an embodiment, and as described further below, turret screw assembly 314 rotates as a single assembly.

Head portion 370, in an embodiment, comprises axially-extending splines 380 configured to engage splines of central portion 348 of indicator carrier 308. In an embodiment, head portion 371 defines threaded head opening 371. Shaft portion 376 extends axially downward from head portion 370, and may include a threaded portion 382 received by seat assembly 320.

Distal end 378 of turret screw assembly 314, may be configured to make contact with erector assembly 118, and in an embodiment, may comprise a flat, disk-like shape, though other structures appropriate for engaging erector assembly 118 are contemplated.

As will be described further below, indexing base 374 is configured to be received by turret collar 316, and in an embodiment, comprises a disk-shaped structure fixedly coupled to shaft 376. In an embodiment, indexing base 374 defines channel 384. Channel 384 extends radially within indexing base 374, defining an opening facing an interior surface of turret collar 316. In an embodiment, channel 384 receives an indexing structure, such as a spring applying force to ball bearing 386, the spring wholly within channel 384, and a portion of the ball bearing extending outward of channel 384. Such an indexing structure forms a portion of what is known in the art as a "clicker" mechanism, allowing turret assembly 314 to be rotated while engaged with collar 316, in predetermined, incremental amounts, typically corresponding to fractions of an MOA.

Figure 13:
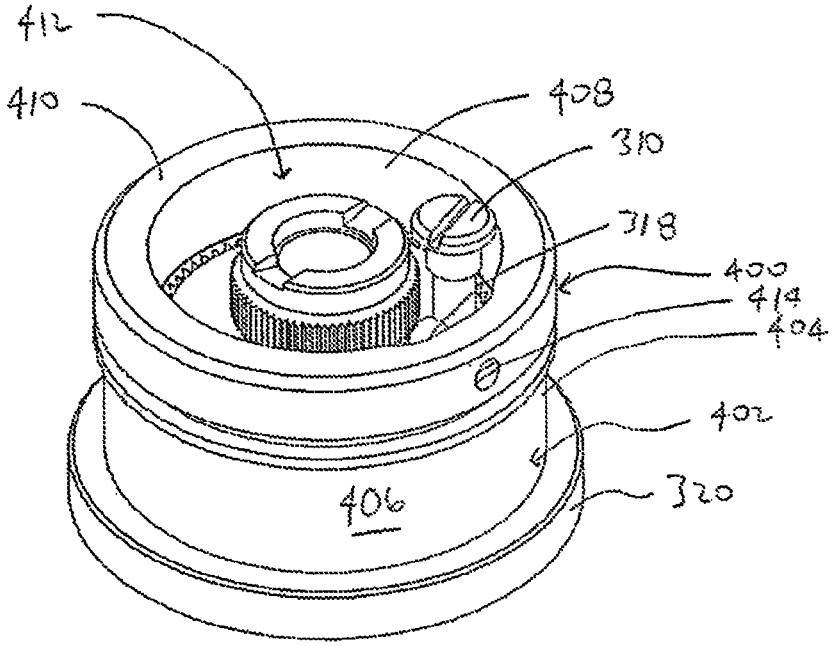
FIG. 13 is a front perspective view of the turret screw assembly and seat assembly of FIG. 12 inserted into a turret collar, according to an embodiment of the invention.

Referring to FIG. 8 depicting turret collar 316, and to FIG. 13 depicting turret screw assembly 314 and seat assembly inserted into turret collar 316, turret collar 316 comprises a sleeve-like, or collar-like structure. Turret collar 316 includes top portion 400, bottom portion 402, perimeter wall 404, outside surface 406, inside surface 408, and top, rim surface 410. Turret collar 316 defines cavity 412 and horizontal stop node cavity 414.

In an embodiment, top portion 400 may comprise a flanged portion adjacent perimeter wall 404. Perimeter wall 404 defines horizontal stop node aperture 414. Horizontal stop node aperture 414 receives horizontal stop node 318, that in an embodiment, comprises a pin or screw that may include indexing flange 420 for indexing horizontal stop node 318 within aperture 414. As depicted, horizontal stop node 318 extends radially through a top portion of perimeter wall 404 into cavity 412. As will be described further below, horizontal stop node 318 is positioned such that it is capable of engaging vertical stop node 310 at either proximal side 422 or distal side 424, depending on the position of vertical stop node 310, thus limiting rotation of indicator carrier 308 and its engaged turret assembly 214.

In an embodiment, a lower portion of inside surface 408 of perimeter wall 404 includes a plurality of axially-extending splines 426 configured to engage ball bearing 386.

Still referring to FIGS. 8 and 13, seat assembly 320 includes upper portion 430, middle portion 432, and lower portion 434. Seat assembly 320 also includes surface 436 that defines central aperture 436 and includes screw threads 438. Central aperture 436 is configured to rotatably receive shaft 376, with seat screw threads 438 engaging turret shaft threads 376.

Referring to FIG. 8, turret ring 322 includes base 440 with surface 442, and perimeter wall 444. Turret ring 322 defines opening 446. Perimeter wall 444, in the embodiment depicted, also includes zero-mark indicator 324.

Referring to FIGS. 8-13, as well as FIGS. 1-3, when assembled, turret ring 322 is affixed to scope body 108 (see FIG. 3); seat assembly is affixed to turret ring 322, such that middle portion 424 is seated on surface 442. Turret collar 316 is affixed to middle portion 424 of seat assembly 320, such that upper portion 420 of seat assembly 320 extends into cavity 412 of turret collar 316. In an embodiment, turret ring 322, seat assembly 320, and turret collar 316 are not rotatable relative to one another and to scope body 108.

Turret screw assembly 214 is received into stop collar 316 and seat assembly 320. Threads 382 of turret screw shaft 376 engage threads 438 of seat assembly 320. Indexing portion 314 of turret screw assembly 314 is received in cavity 412 of turret collar 316, with ball bearing 386 engaging inner surface 408 and its splines 426. Horizontal stop node 318 is received by horizontal stop node aperture 414, extending inward into cavity 412.

Top portion 400 of turret collar 316 is rotatably received into cavity 356 of indicator carrier 308. Head portion 370 of turret screw assembly 314 is received by central aperture 352 of indicator carrier 308, with splines 380 of head portion 370 engaging splines of central portion 348 of indicator carrier 308, thereby securing turret assembly 314 to indicator carrier 308.

Vertical stop node 310 is received by aperture 356 of indicator carrier 308, extending axially downward into cavity 356.

Indicator pins 312 are received by channels 358.

Disk 306 is received by recess 354 of indicator carrier 308.

Cap 304 is placed over top portion 340 of indicator carrier 308, with cap shaft 330 being axially received by central aperture 352 of indicator carrier 308 such that shaft 330 is coupled to indicator carrier 308.

Shaft 338 of cap fastener 302 is received through fastener opening 334 of cap 304 and central aperture 352. Shaft 338 is received by head opening 371. In an embodiment shaft 338 includes a threaded portion that engages with threads in head opening 371; head portion 336 of fastener 302 is received by fastener recess 332 of cap 304. Consequently, cap fastener 302 and cap 304 are secured turret screw assembly 314 such that rotation of cap 304 causes rotation of turret screw assembly 314.

In operation, a user or shooter grips and rotates cap 304, aligning a selected indicator pin 312 with zero-mark indicator 324 of turret ring 324. Rotation of cap 304 causes turret screw assembly 314 to move axially within seat assembly 320. Because turret screw assembly 314 is engaged to erector assembly 108 at bottom portion 378, axial movement of turret screw assembly 314 causes movement of erector assembly 108 and its reticle cell 120.

Figure 14:
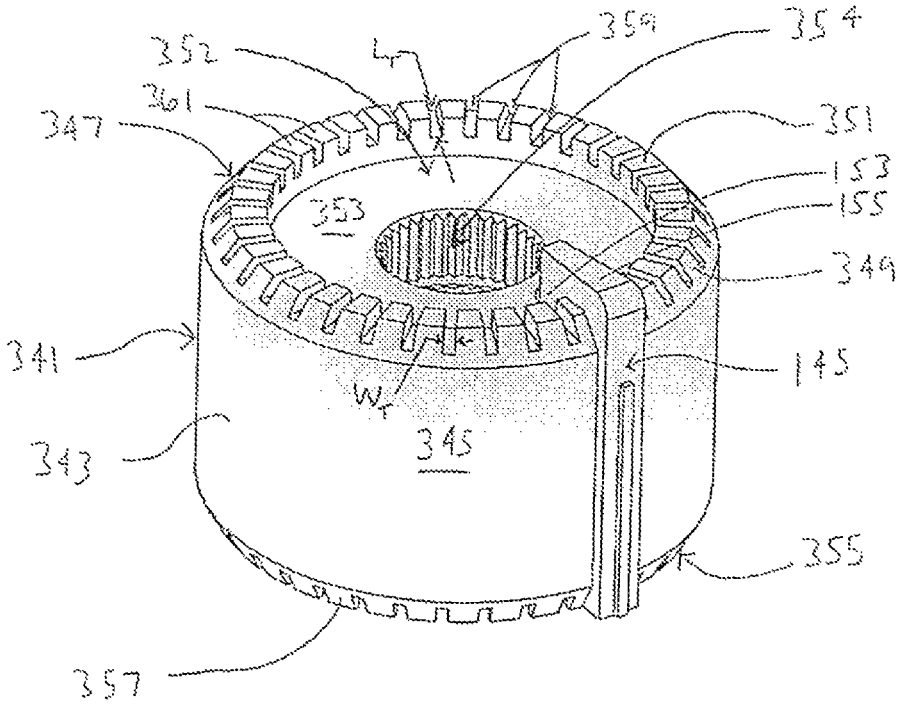
FIG. 14 is a front perspective view of an alternate embodiment of an indicator carrier with an indicator pin, according to an embodiment of the invention.
Figure 15:
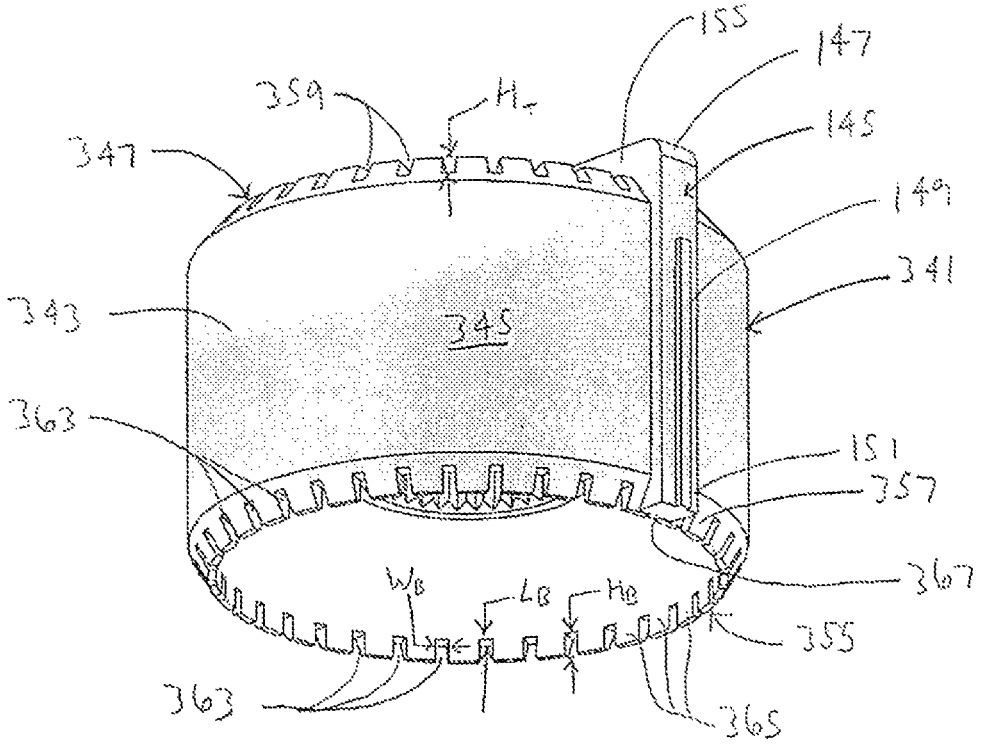
FIG. 15 is a bottom perspective view of the indicator carrier and indicator pin of FIG. 14.
Figure 16:
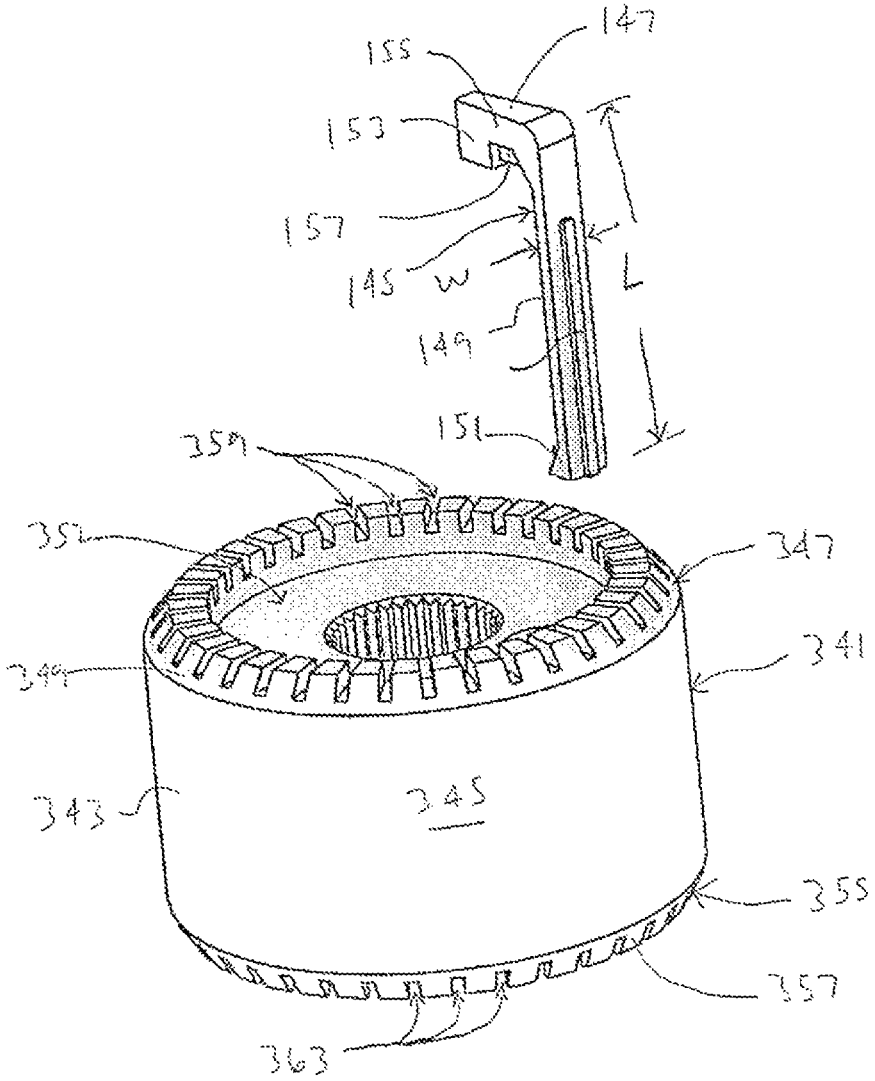
FIG. 16 is an exploded view of the indicator carrier and indicator pin of FIG. 14.

Referring to FIGS. 14-16, an alternate embodiment of an indicator carrier and corresponding pin are depicted.

Referring specifically to FIGS. 14 and 15, indicator carrier 341 with indicator pin 145 are depicted. In this alternate embodiment, indicator carrier 341 is substantially similar to indicator 340, except as noted below. Indicator pin 145 is substantially similar to indicator pin 144, with some modified features such that pin 145 can be received by the modified structure of indicator 341.

In an embodiment, indicator carrier 341 comprises perimeter wall 343 with outer perimeter surface 345, top end 347, top beveled edge 349, top surface 351, inside surface 353, bottom end 355, and bottom beveled edge 357. Similar to indicator carrier 340, indicator carrier 341 defines central aperture 352 and top recess 354.

In an embodiment, perimeter wall 343 forms a contiguous cylindrical shape. Perimeter wall 343 extends circumferentially about the entire circumference of indicator carrier 341. Perimeter wall 343 extends axially from top beveled edge 349 to bottom beveled edge 357. Perimeter wall defines outer perimeter surface 345, which in an embodiment is uniformly curvilinear and free from surface variations, channels, openings, and so on. In an alternate embodiment, perimeter wall 343 may define one or more recesses or channels for receiving and securing portions of pin 145.

Top end 347 includes top beveled edge 349 and top surface 351. In an embodiment, top beveled edge 349 extends circumferentially about top end 347 of indicator carrier 341. Top beveled edge 349 angles radially inward from perimeter wall 343 toward top surface 351. In an embodiment, an angle formed between perimeter wall 343 and top beveled edge 349 is greater than or equal to 90° and less than 180°. In one such embodiment, the angle formed between perimeter wall 343 and top beveled edge 349 ranges from 100° to 170°. In another embodiment, the angle ranges from 120° to 150°. In another embodiment, the angle formed between perimeter wall 343 and top beveled edge 349 is substantially 135°.

Top end 347 and top beveled edge 349 define a plurality of top channels 359. Top channels 359 are distributed about top end 347. In an embodiment, and as depicted, top channels 359 are distributed equidistantly about top end 347. In an embodiment, and as depicted, top channels 359 are open at a top end, inside end, and outside end.

Each top channel 359 defines a length $L_T$ extending along a bottom of the channel from the outside (top beveled edge side) radially inward to cavity 352; each top channel defines an axial height $H_T$ extending axially from a bottom end of the channel to a top end of the channel; and each top channel defines a width $W_T$. In an embodiment, width $W_T$ may be larger than length $L_T$; in another embodiment, length $L_T$ may be larger than width $W_T$; in another embodiment, height $H_T$ may be larger than one or both of length $L_T$ and width $W_T$; in other embodiments, other relative sizes are possible. In an embodiment, width $W_T$ is uniform from outside to inside; in another embodiment, width $W_T$ is larger at an outside portion of a top channel 359 as compared to an inside portion of the same top channel 359.

Top end 347 also includes a plurality of projections 361 formed between the plurality of top channels 359. Top surfaces of the plurality of projections 361 together form top surface 351.

Bottom end 355 includes bottom beveled edge 357. In an embodiment, bottom beveled edge 357 extends circumferentially about bottom end 355 of indicator carrier 341. Bottom beveled edge 357 angles radially inward and axially downward from perimeter wall 343. In an embodiment, an angle formed between perimeter wall 343 and bottom beveled edge 355 is greater than or equal to 90° and less than 180°. In one such embodiment, the angle formed between perimeter wall 343 and bottom beveled edge 355 ranges from 100° to 170°. In another embodiment, the angle ranges from 120° to 150°. In another embodiment, the angle formed between perimeter wall 343 and bottom beveled edge 355 is substantially 135°.

Bottom end 355 and bottom beveled edge 357 define a plurality of bottom channels 363. Bottom channels 363 are distributed about bottom end 355. In an embodiment, and as depicted bottom channels 363 are distributed equidistantly about bottom end 355. In an embodiment, and as depicted, bottom channels 363 are open at a top end, inside end, and outside end.

Each bottom channel 363 defines a length $L_B$ extending along a bottom of the channel from the outside (bottom beveled edge side) radially inward toward central aperture 354; each bottom channel 363 defines an axial height $H_B$ extending axially from a bottom end of the channel to a top end of the channel; and each bottom channel 363 defines a width $W_B$. In an embodiment, width $W_B$ may be larger than length $L_B$; in another embodiment, length $L_B$ may be larger than width $W_B$; in another embodiment, height $H_B$ may be larger than one or both of length $L_B$ and width $W_B$; in other embodiments, other relative sizes are possible. In an embodiment, width $W_B$ is uniform from outside to inside; in another embodiment, width $W_B$ is larger at an outside portion of a bottom channel 363 as compared to an inside portion of the same bottom channel 363.

Bottom end 355 also includes a plurality of projections 365 formed between the plurality of bottom channels 365.

Referring also to FIG. 16, an exploded version of indicator carrier 341 and an indicator pin 145 are depicted (pin 145 detached from indicator carrier 341). As depicted, indicator pin 145 is substantially similar to indicator pin 144 described above. However, in this embodiment of an indicator pin, indicator pin 145 is configured to be received at top end 347 and bottom end 355 of indicator carrier 341, rather than being received along perimeter wall 343.

In an embodiment, indicator pin 145 includes top portion 147, body portion 149, and bottom portion 151. In an embodiment, and as depicted, indicator pin 145 generally forms an upside-down "J" or "L" shape. Although only one indicator pin 145 is depicted, it will be understood that a turret 104 or 300 may include a plurality of indicator pins 145.

Top portion 147 includes vertical portion 153, horizontal portion 155, and projection portion 157. Vertical portion 153 extends downwardly and away from horizontal portion 155, and when installed onto indicator carrier 341, is received into cavity 352. In an embodiment, vertical portion 153 is in contact with surface 353 of indicator carrier 341. In other embodiments, vertical portion 153 is not in contact with surface 353 of indicator carrier 341. In an embodiment, vertical portion 153 may extend beyond surface 353 into a cavity defined by surface 353 (not depicted).

Horizontal portion 155 extends between vertical portion 153 and body portion 149.

In an embodiment, projection portion 157 extends radially between vertical portion 153 and body portion 149. Projection portion 157 also extends axially away from horizontal portion 155, and is generally configured to fit into a top channel 359 of indicator carrier 341. In an embodiment, projection portion 157 conforms to the shape of a top channel 359, such that is complementary to the shape of the channel. In an embodiment, projection portion 157 is received firmly and securely by a top channel 359. In another embodiment, projection portion 157 fits loosely into a top channel 359.

Body portion 149 extends axially from top portion 147 to bottom portion 149. In an embodiment, body portion 149 defines a length L that is greater than a width W. In an embodiment, Length L is more than twice the size of width W. In other embodiments, the relative sizes of length L and width W may vary.

In an embodiment, body portion 149 may include axial ridge 159. When included, ridge 159 may provide a tactile structure for a user.

In an embodiment, bottom portion 151 may be wedge-shaped, or triangular, so as to conform to bottom beveled edge 357. In such an embodiment, an inside surface of bottom portion 151 is in contact with beveled edge 357 as depicted.

Bottom portion 151, in an embodiment, includes projection portion 367. Projection portion 367 is configured to be received' by a bottom channel 363. As such, projection portion 367 may be complementary in shape to a bottom channel 363.

As described in part above, when indicator pin 145 is assembled onto indicator carrier 341, projection portion 157 of top portion 147 of indicator pin 147 is received by a top channel 359, thereby securing top end 147 to indicator carrier 341. Projection portion 367 is received by a bottom channel 363, thereby securing bottom portion 151 of indicator pin 145 to indicator carrier 341. In the depicted embodiment, body portion 149 is not directly coupled to wall 343.

One advantage of the smooth outer surface 345 of indicator carrier 341, and coupling of indicator pin 145 at a top and bottom portion is that the design minimizes crevices and recesses that might otherwise accumulate dirt and debris. Further, a majority of an outside surface of indicator pin 145 is viewable, and not hidden.

In an alternate embodiment, rather than employing pins 145 received by channels 359 and 363, adhesive indicator markers (not depicted) may be attached to smooth wall 343 at the desired locations. Such adhesive indicator markers may be elongated, extending from top to bottom, or may be circular, or otherwise shaped.

Figure 17A:
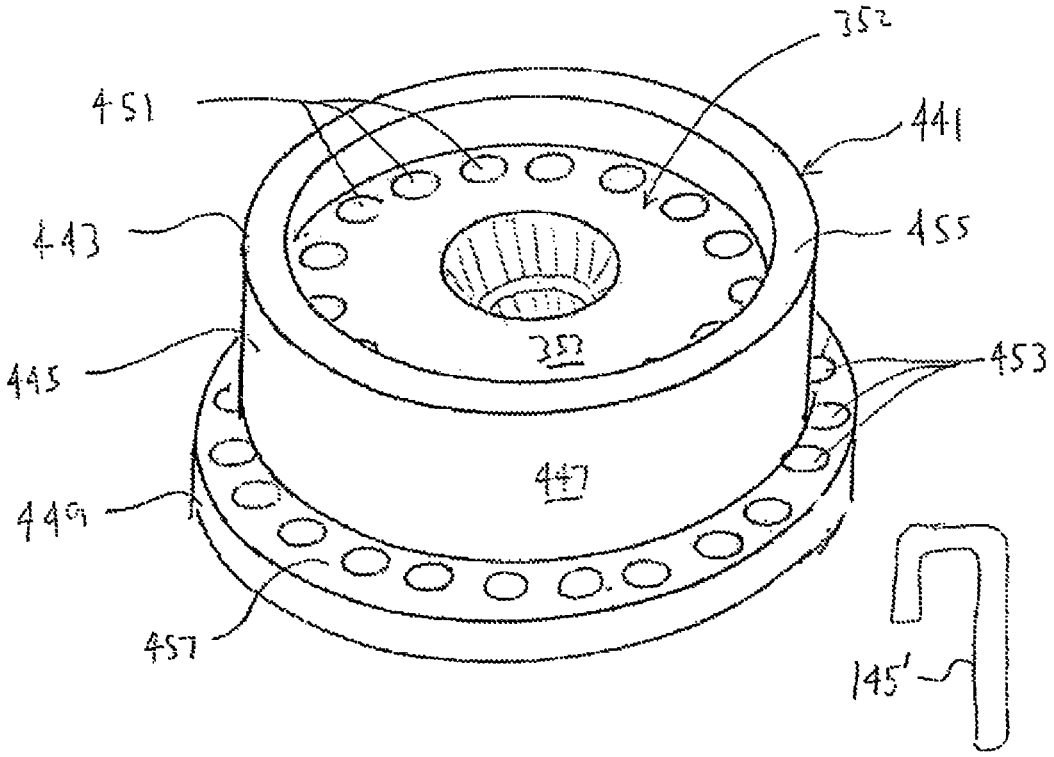
FIG. 17A is a top perspective view of another embodiment of an indicator carrier.
Figure 17B:
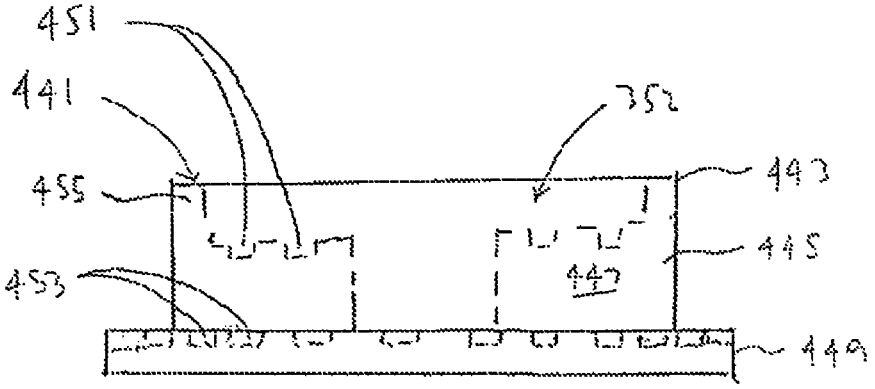
FIG. 17B is a side view of the indicator carrier of FIG. 17A.

Referring to FIGS. 17A and 17B, another alternate embodiment of an indicator carrier is depicted. Indicator carrier 441 shares many of the structures and features of indicator carriers 142 and 341, and may be configured for use with a turret 104.

In an embodiment, indicator carrier 441 comprises top portion 443, perimeter wall 445 with outside surface 447, and bottom portion 449. Indicator carrier 441 defines cavity 352, a plurality of top indicator-pin-receiving holes 451, and a plurality of bottom indicator-pin-receiving holes 453.

Top portion 443 includes top ledge 455 and defines surface 353. Surface 353 defines the plurality of top indicator-pin-receiving holes 451. Ledge 455 extends about a circumference of top portion 443, and extends axially away from surface 353.

In an embodiment, top-indicator-pin-receiving holes 451 comprise a circular opening, forming a cylindrical cavity. In other embodiments, holes 451 comprise other shapes, such as square, rectangular, and so on. Generally, holes 451 are configured and shaped to receive a top portion of an indicator pin, such as a vertical portion 153 of an indicator pin 145.

As compared to indicator carrier 347, indicator carrier 441 does not include channels in a top portion, such as ledge 455. Rather, indicator pins, such as depicted indicator pin 145', are received and secured via holes 451.

In an embodiment, and as depicted perimeter wall 445 defines a smooth contiguous surface 447, similar to perimeter wall 343 and 345 of indicator carrier 341.

In an embodiment, bottom portion 449 forms a flanged portion, defining surface 457. Bottom indicator-pin-receiving holes 453 are defined by bottom portion 449 and surface 457. In an embodiment, and as depicted, bottom indicator-pin-receiving holes 453 are distributed equidistantly about bottom portion 449.

In an embodiment bottom-indicator-pin-receiving holes 453 comprise a circular opening, forming a cylindrical cavity. In other embodiments, holes 453 comprise other shapes, such as square, rectangular, and so on. Generally, holes 453 are configured and shaped to receive a bottom portion of indicator pin 145'.

When indicator pin 145' is assembled onto indicator carrier 441, the pin is secured at a top portion and a bottom portion, though generally, not at perimeter wall 445.

The above embodiments of a multiple-zero-point turret 104 and 300, as well as their various indicator carrier embodiments, combine with ballistics reference system 106 to form riflescope aiming system 107 of riflescope 100.

Referring to FIGS. 18A-18F, additional alternate embodiments of a multiple-zero-point elevation turret, including alternate embodiments of indicator carriers and indicator pins, are depicted.

Figure 18A:
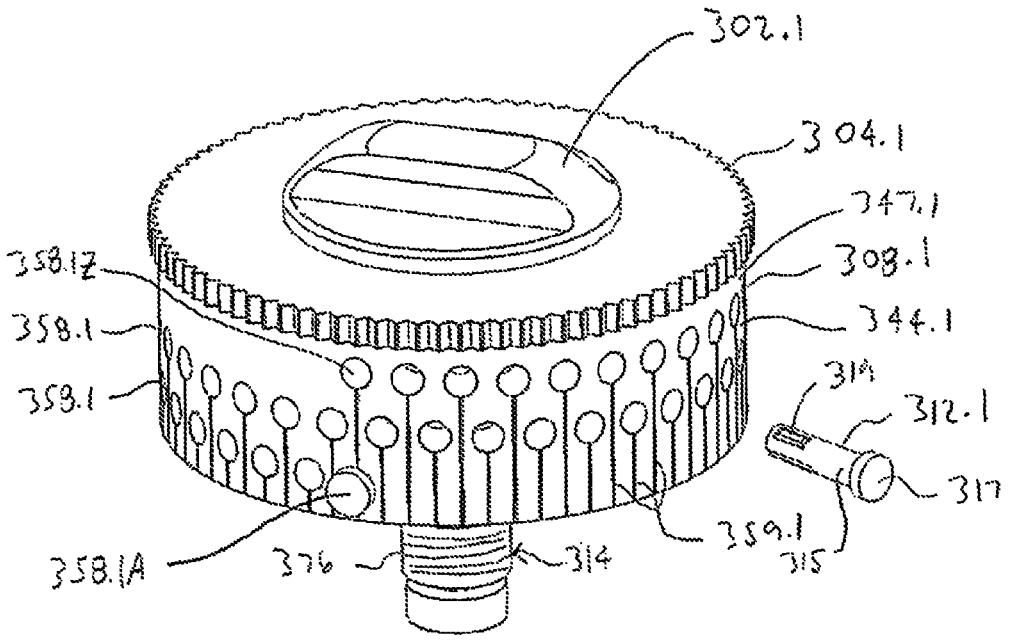
FIG. 18A is a top perspective view of a cap, indicator carrier, and turret screw assembly, according to an embodiment of the invention.

Referring specifically to FIG. 18A, a multiple-zero-point elevation turret subassembly, including fastener 302.1, cap 304.1, indicator carrier 308.1, indicator pin 312.1, and turret screw assembly 314 with turret shaft 376, is depicted. In this embodiment, a relatively larger number of indicator pins 312.1 provide increased turret resolution, such that the turret may be adjusted in smaller increments, or MOA.

In this alternate embodiment, similar to embodiments described above, fastener 302.1 secures cap 304.1 and indicator carrier 308.1 with indicator pins 312.1 to a turret screw assembly 314, such that the rotation of cap 304.1 and indicator carrier 308.1 causes turret screw shaft 376 of turret screw assembly 314 to rotate. In this embodiment, indicator carrier 308.1 and cap 304.1 are relatively short, providing a relatively low profile turret.

In this depicted alternate embodiment, indicator carrier 308.1 includes perimeter wall 344.1 defining a plurality of pin-receiving holes 358.1. In the embodiment depicted, wall 344.1 defines three rows of pin-receiving holes 358.1, a top row, middle row, and bottom row. Alternately, and as described below, holes 358.1 form a single helical row, with subsequent holes being located vertically above a previous hole. Associated with each pin-receiving hole 358.1 is an indexing mark 359.1 extending downward from the hole. In an embodiment, holes 358.1 of each row are distributed such that none of the holes are aligned vertically with another.

In an embodiment, indexing marks 359.1 extend downwardly to a bottom of indicator carrier 308.1, so that pins 312.1 and indexing marks 359.1 may be easily aligned with a zero indicator on a scope base, such as fixed zero indicator 200 depicted in FIG. 3.

In an embodiment, indicator carrier 308.1 is limited to rotation of approximately 360°. In another embodiment, indicator carrier 308.1 may rotatable more than 360°, such that a bottom row of holes 358.1 corresponds to a first rotation (approximately 0° to 360° of rotation), a middle row of holes corresponds to a second rotation (approximately 360° to 720°) and a top row of holes corresponds to a third rotation (approximately 720° to) 1080°.

In the latter embodiment of multiple rotations, holes 358.1 may be distributed helically, rather than in multiple "rows". In such an embodiment, hole 358.1A is the first hole in a series, and hole 358.1Z is the last hole, such that a pin at hole 358.1A indicates and corresponds to a minimum elevation adjustment, and a pin at hole 358.1Z indicates and corresponds to a maximum elevation adjustment. In an embodiment, each successive hole 358.1 is located slightly further towards a top 347.1 of indicator carrier 308.1, creating the helical series of holes.

In the embodiment employing the helical arrangement of holes 358.1, and capable of rotating greater than one full rotation, the stop node arrangement of the previously-described embodiments limiting turret rotation to one rotation may not be most convenient. Although such an arrangement may be used, at each rotation, the turret would need to be removed, rotated slightly to avoid engagement of the stop nodes, then replaced. As such, a stop node arrangement that included a "hard stop" or lower limit, and no upper limit may be preferable. Such a stop node arrangement and structure is described in U.S. Pat. No. 8,166,696 issued May 1, 2012 to Hamilton, and entitled "Rifle Scope with Adjustment Stop", which is herein incorporated by reference in its entirety.

Indicator pins 312.1 in an embodiment comprise shaft portion 315 and head portion 317. Each shaft portion 315 is received by a hole 358.1, leaving head portion 317 exposed and visible. As in embodiments described above, a plurality of indicator pins 358.1, some having different colors, may be used. Pins 358.1 are inserted radially (horizontally) into indicator carrier 308.1. In the embodiment depicted, pins 358.1 include tabs or projections 319 that engage an inside surface of the holes when pushed into the holes.

In an embodiment, pins 358.1 may be translucently colored, and lit from a light source located under cap 304.1, thereby causing pins 358.1 to be more visible. In another embodiment, a light source is stationary under cap 304.1 and illuminates a single, fixed point. As indicator carrier 308.1 is rotated, an individual pin 312.1 will align with the lighted point and thereby become illuminated. In another embodiment, indicator markers or pins 358.1 may be photoluminescent, or otherwise self-illuminating.

Figure 18B:
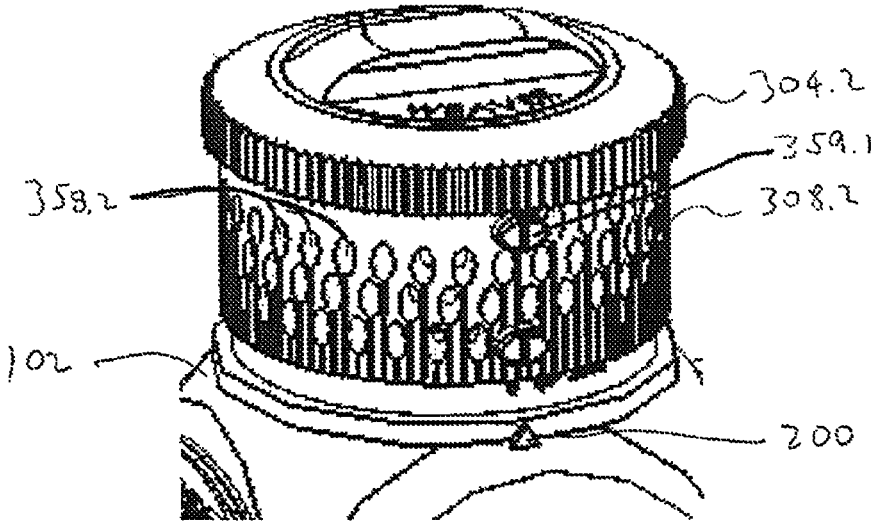
FIG. 18B is a top perspective view of a multiple-zero-point elevation turret, according to another embodiment of the invention.

Referring to FIG. 18B, another embodiment of a multiple-zero-point elevation turret 104.2, similar to the one described above with respect to FIG. 18A is depicted. In this embodiment, turret 104.2 and its indicator carrier 308.2 and cap 304.2 are relatively tall as compared to indicator carrier 308.1, improving visibility and graspability. Further, in this embodiment, indicator pins 358.2 may be threaded such that they are screwed into threaded holes 358.2.

Figure 18C:
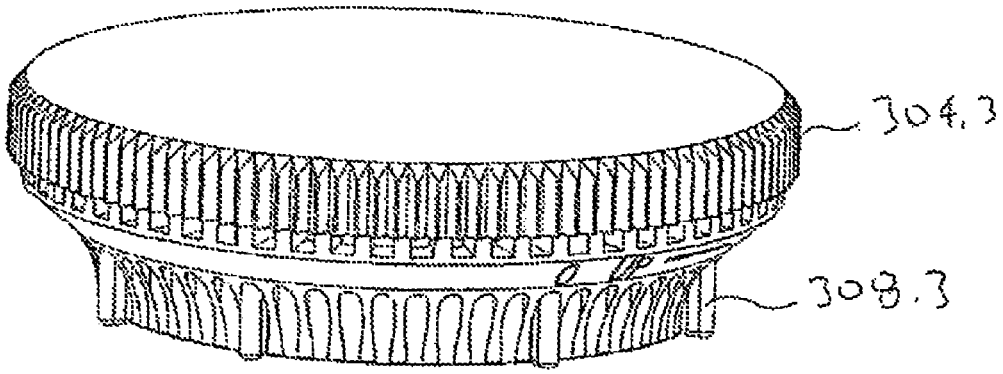
FIG. 18C is a top perspective view of a cap and indicator carrier, according to an embodiment of the invention.
Figure 18D:
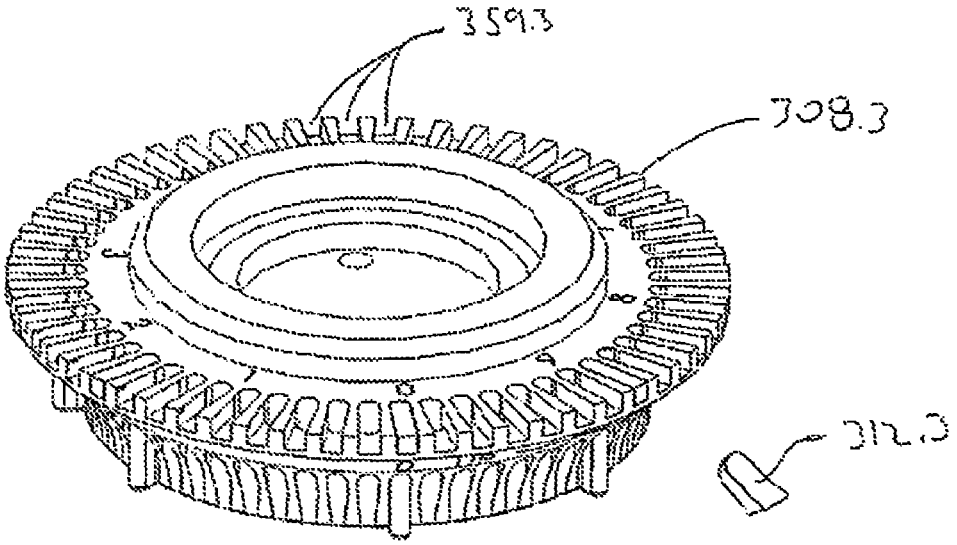
FIG. 18D is a top perspective view of the indicator carrier and indicator marker of FIG. 18C.

Referring to FIGS. 18C and 18D, an alternate embodiment of a cap 304.1 and an indicator carrier 308.3 are depicted. The depicted embodiment provides a low-profile design with improved resolution.

In this embodiment, indicator carrier 308.3 defines a plurality of horizontal, or radial, slots 359.3 for receiving indicator markers 312.3. In this embodiment, complementary shaped indicator markers or pins 312.3 may be placed into each of slots 359.3. Alternatively, slots 359.3 may be lit from within indicator carrier 308.3. As depicted, a large number of slots 359.3 may be present such that resolution is increased, i.e., an incremental rotation of one "slot" results in a smaller amount of turret screw rotation. In an embodiment, a rotation of one "slot" is equivalent to 0.2 MOA.

Figure 18E:
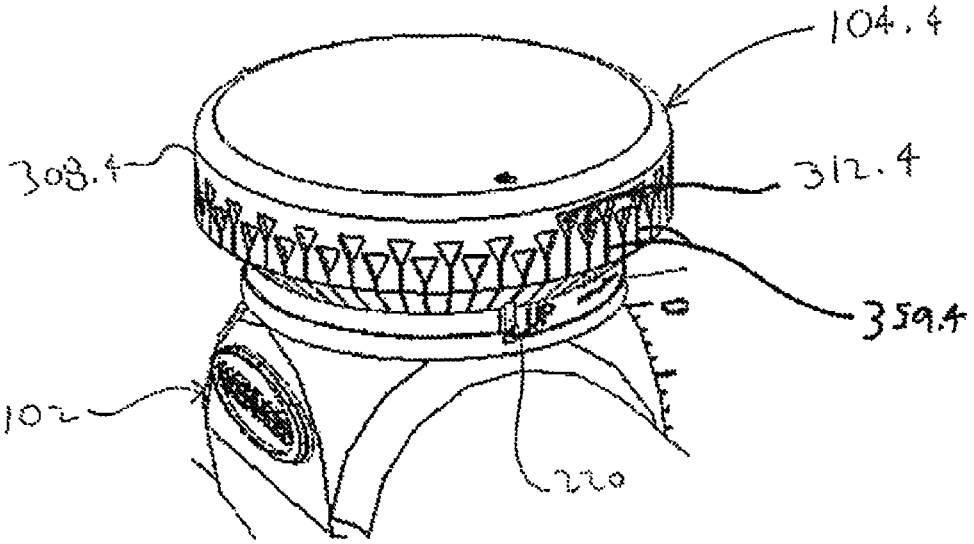
FIG. 18E is a top perspective view of a multiple-zero-point elevation turret having a low profile, according to an embodiment of the invention.

Referring to FIG. 18E, another alternate embodiment of a multiple-zero-point elevation turret, turret 104.4, is depicted. In this embodiment, a cap and indicator carrier are combined, and referenced as carrier 308.4. This particular embodiment provides relatively high resolution combined with easily perceived indicator markers 312.4.

In an embodiment, multiple-zero-point elevation turret 104.4 includes multiple rows of indicator markers 312.4 with corresponding index marks 359.4. In an embodiment, turret 104.4 includes 20-60 indicator markers 312.4; in another embodiment, turret 104.4 includes 54 indicator markers 312.4.

As depicted, indicator markers 312.4 are arranged helically, as described above with respect to an embodiment of indicator carrier 308.1.

Figure 18F:
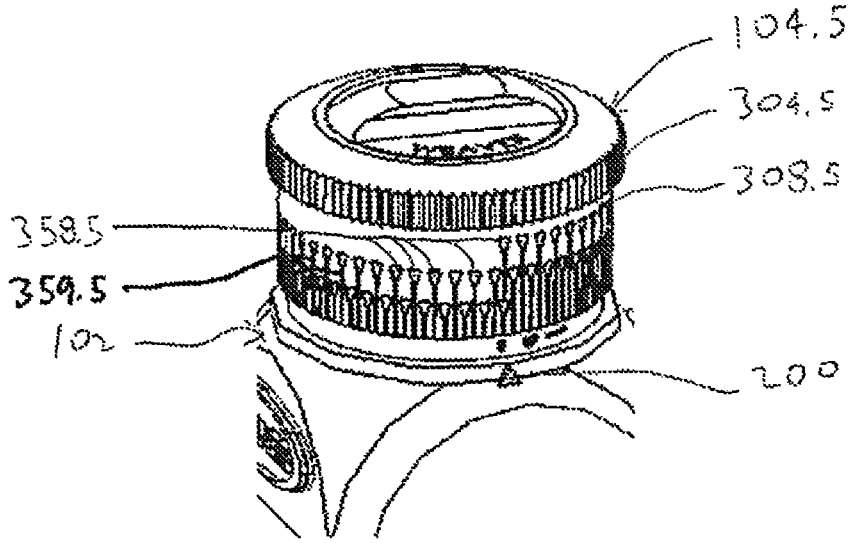
FIG. 18F is a top perspective view of a high-resolution multiple-zero-point elevation turret, according to an embodiment of the invention.

Referring to FIG. 18F, another alternate embodiment of a multiple-zero-point elevation turret, turret 104.5 is depicted. Turret 104.5 shares many features of turret 104.4 described above with respect to FIG. 18E. In an embodiment, and as depicted, turret 104.5 includes a separate cap 304.5 that is not integrated with indicator carrier 308.5.

In this super-high resolution embodiment having a relatively tall indicator carrier 308.5, a high number of indicator markers 358.5 are present. In an embodiment, the plurality of indicator markers 358.5 are arranged helically, as described above. Each indicator marker 358.5 includes a corresponding index mark 359.5 extending downward to bottom portion 355.5 of indicator carrier 308.5, such that each indicator marker 358.5 can be easily aligned with zero indicator 200 of scope 102.

Figure 19:
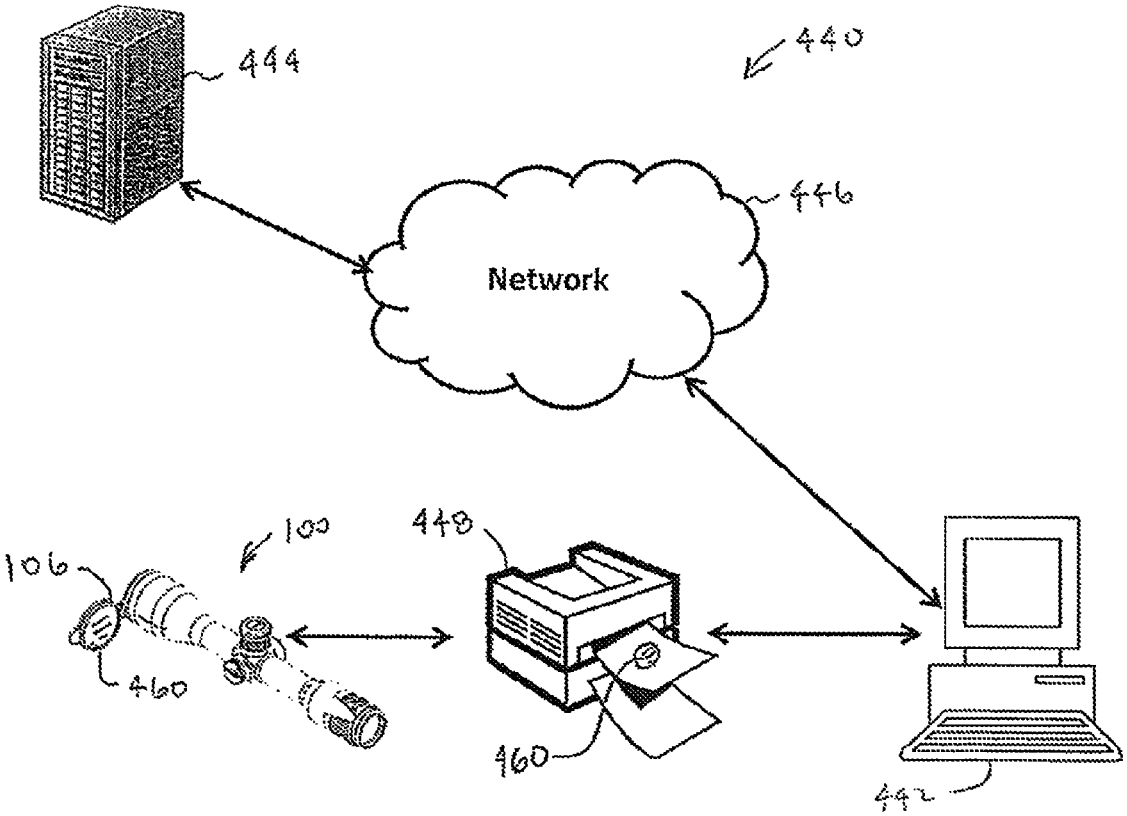
FIG. 19 depicts a ballistics calculation and reference card generation system, according to an embodiment of the invention.

Referring to FIG. 19, a ballistics calculation and reference card generation system 440 may be used to generate elements of ballistics reference system 106 and riflescope aiming system 100. In an embodiment, system 400 may be used to determine proper pin 144 placement about carrier 142, thereby avoiding the trial-and-error method described above of setting multiple zero points for multiple target distances. Further system 400 may be used to generate reference data in the form of color-coded ballistic reference cards, as explained further below.

In an embodiment, ballistics calculation and reference card generation system 440 includes an interface device 442, remote server 446, network 446, printer 448, and ballistics reference system 106 of rifle scope 100. Interface device 442 may comprise a computer, such as a client computer, smart phone, or other such computing or calculation device. Remote server 444 may be local or remote, and includes a database or similar collection of ballistics data. Remote server 444 may be connected to interface device 442 through network 446, which may be a local network (LAN), or a wide-area network (WAN), including the Internet. In an embodiment, printer 448 is in communication with interface device 442.

Either server 444 or interface device 442 may include a processor and memory comprising a ballistics calculator that is configured to receive ballistics data from the database and/or from user-inputted data, and to make calculations to determine elevation turret and windage settings for various target distances based on the data. As understood by those skilled in the art, a number of factors affect the path of travel of a projectile fired from a firearm, including distance, firearm characteristics, projectile characteristics, and so on.

Ballistics data may be stored in a database of server 444, or directly on interface device 442. Ballistics data may include data such as ammunition data, firearm data, and so on, and in some embodiments may also include environmental data, firearm identification data, and so on. The processor receives some ballistics data input from a user, such as ammunition type, rifle, and so on, and in some cases receives ballistics data from stored data in the ballistics database accessible to the processor/ballistics calculator. In an embodiment, the ballistic calculator determines an elevation adjustment based on the received and stored data, and for a predetermined or received distance. The elevation adjustment is correlated to an indicator pin 144/312 placement on indicator carrier 142/308. The placement being identified by the angular position indicia 164 or MOA labels on surface 150 of carrier 142.

For example, 200 yards may correspond to "0" MOA, 300 yards may correspond to 2 MOA, 400 yards may correspond to 4.5 MOA, and so on. Such information may or may not be printed on ballistics reference cards, as will be explained further below.

The processor may comprise a portion of a ballistics calculator that not only determines pin placement, but also matches pin colors to predetermined, desired distances. For example, a ballistics calculator of the invention may receive ballistics data and desired distances from a user through the electronic interface, then transmit or display data to the user that includes pin color and placement for each desired target distance. As will be described in greater detail below, some such transmitted data may be printed onto a reference card or disk for installation onto telescopic sight 102 for easy viewing by the user.

Further, the ballistics calculator may also calculate a wind hold value for each of the predetermined target distances, and based upon received ballistics and possibly other data. As also described below in greater detail, such wind hold values may also be printed or otherwise displayed to a user.

Figure 20:
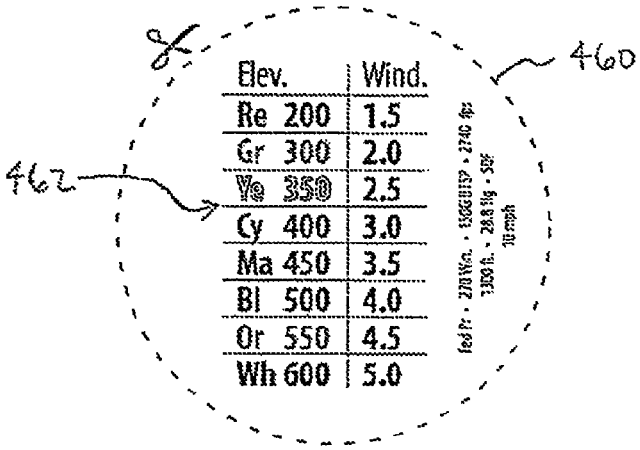
FIG. 20 depicts a ballistics reference card, according to an embodiment of the invention.

Referring also to FIG. 20, an embodiment of ballistics reference card 460 is depicted. In an embodiment, and as suggested above, ballistics reference card 460 may comprise a paper or similar material suitable for use with printer 448. In this particular embodiment, ballistics reference card 460 may be cut into a convenient shape, such as a circular shape, as depicted. As will be described further below, a circularly shaped ballistics reference card 460, or ballistic reference disk 460, may be placed into components of ballistics reference system 106 for easy viewing and reference.

In other embodiments, ballistic reference card 460 may comprise other material, such as cardboard, plastic, and so on. Further, ballistic reference card 460 may comprise a square, rectangular, or other shape, and is not limited to a circular or disk shape.

Ballistics reference card 460 includes a plurality of ballistics data indicia 462. Indicia 462 may be printed directly onto card 460, such as by printer 448. In other embodiments, ballistics data indicia 462 may otherwise be affixed, adhered, or otherwise attached to ballistics reference card 460.

Ballistics data indicia 460 may indicate a wide variety of ballistics data. In an embodiment, ballistics data includes ballistic data sets, each set comprising a distance and a distance key, such as a color key. In an embodiment, the distance key, or color, corresponds to a matching color of one of indicator pin 144 (or other markers or pins) of multiple-zero-point elevation turret 104 (or other turrets described herein). For example, for a distance of 200 yards, a distance key may comprise the color red and the letters "Re". The letters Re and the number "200" are printed in red. Further, a highly-visible colored pin 144 of multiple-zero-point turret 104 corresponding to a 200 yard zero point is colored red, with the rifle sighted in for 200 yards when the red pin 144 is aligned with zero indicator 200.

The ballistics data may also include an angular position indicia 164 corresponding to the distance key. For example, for a first distance of 200 yards, the provided ballistics data may indicate that 200 yards corresponds to a "0", a first angular position indicia, the angular position indicia corresponding to pin placement on indicator carrier 142. In such an example, 200 yards would correspond to a minimum distance for scope 102; the red pin would be placed on indicator carrier 102 at a pin channel adjacent the "0" angular position indicia 164.

In the same provided ballistics data set, for a second distance of 300 yards, not only would the distance include a second distance key, such as white, for example, but a second angular position indicia would be provided. The second angular position indicia would indicate pin placement on indicator carrier 142 for the second, white pin, corresponding to 300 yards. In this case, a white pin would be placed in a pin channel adjacent the second angular measurement indicia, which in this example may be 2.0. Similar distance or color keys and angular position indicia would be provided for the various desired distances. With both the distance key and angular position indicia for each distance, pins 144 may be placed onto indicator carrier 142, such that each pin 144 on indicator carrier 142 corresponds to a zero point at each predetermined distance.

Angular position indicia 164 corresponding to each distance key or color may be printed on reference disk 460. In an embodiment, angular position indicia 164 may be printed on a back side of reference disk 460 so as to not distract a shooter viewing the reference card. In another embodiment, angular position indicia 164 is only viewed on a screen, or is printed on a separate sheet for use in setting up turret 104 with appropriately placed pins 144.

As such, a user can easily configure an indicator carrier and turret in advance of a shooting event, and without having to zero in the rifle for distances other than the minimum distance as described above.

In other embodiments, other distance keys may be used. In one such embodiment, numbers corresponding to angular position indicia 164, with or without a color key, may be used.

Other data associated with a particular data set may also be displayed along with the unique color corresponding to the determined indicator pin color.

In an embodiment, each data set may also include wind hold or windage information. Wind hold information may be displayed using angular measurement increments, such as MOA increments, that correspond to MOA indicia of a reticle of telescoping sight 102, as described below with respect to FIG. 33. As such, a user may choose to adjust the wind hold via windage adjustment turret 124, such that the reticle crosshairs or dot is centered on the target, or alternatively, may leave the windage turret zeroed, and more quickly move the relative reticle center off target to account for wind.

Further, ballistics data indicia 460 may also include additional data such as load data; projectile velocity; altitude, pressure and temperature basis; wind assumptions/basis for wind hold data (e.g., 10 mph); firearm data; scope or firearm identification data; and so on.

In the embodiment depicted, ballistics data indicia 460 is formatted as a table, with elevation information displayed in a first, elevation data column, windage information displayed in a second, windage column, and additional ballistics information, some of which serves as an identification of card 460, displayed adjacent the elevation-windage table. In the depicted embodiment, corresponding elevational angular position indicia 164 corresponding to turret 104 are not included on ballistics reference card 460, though in other embodiments, MOA indicia 164 may be included.

Including the angular position indicia 164 corresponding to pin 144 placement may be particularly helpful if multiple ballistics cards 460 for different types of ammunition, barrels, and so on, are used in the field. In such an embodiment, each reference disk 460 includes not only distances with distance or color keys, e.g., red colored numbers "200" for 200 yards and a red pin 144, the associated angular position indicia 164 is also provided for each distance. A first reference card 460 may correspond to a first ammunition type, while a second reference card 460 may correspond to a second ammunition type. In an embodiment, the ballistics data sets both include the same distances, with the same color keys, but the angular position indicia 164 provided would be different, indicating different pin placements for the different distances. In this manner, ammunition, or other ballistic factors, could be changed in the field, and the shooter would have a reference for changing pin placement on turret 104 to accommodate the change in ammunition.

In another similar embodiment wherein two or more ballistics reference cards 460 are included in a system, angular position indicia 164 may be held constant for the two ballistic data sets even though a ballistics factor, such as ammunition type, is changed. Such a configuration would allow a shooter or user to leave pin placement on turret 104 unchanged. However, the distances indicated on the first and the second reference cards 460 would be different. For example, for a first ammunition type, the ballistics data set printed on a first reference disk 460 provides distances 200, 300, 400, and 500, color coded as red, white, blue, and yellow. For a second ammunition type, the second ballistics data set printed on the second reference disk 460 provides distances 220, 330, 450, and 580, in the same respective colors, red, white, blue and yellow. In this embodiment, pins 144 would not have to be moved on turret 104. However, with the second ammunition type, each colored pin now corresponds to a second distance. In this case, after a shooter determines a target distance, the shooter would choose the appropriate pin, which may be different for the first reference disk as compared to the second reference disk.

As such, in an embodiment, the invention includes a first ballistics reference disk or ballistics data set, having a first set of distances, a first set of distance keys, and a first set of angular position indicia, and a second ballistics reference disk or ballistics data set, having a second set of distances, a second set of distance keys, and a second set of angular position indicia, the first and second sets of distance keys being the same, the first and second angular position indicia corresponding to the distance keys being the same, but the first set of distances and the second set of distances being different.

Other embodiments of the invention include methods of configuring a multiple-zero-point turret 104. In one such embodiment, a method of configuring multiple-zero-point turret 104 includes one or more of the following steps: entering rifle and ammunition data into a ballistics calculator via interface device 442; generating elevation angular measurement data corresponding to a plurality of predetermined target distances using a computer processor, such as a processor of interface device 442 or server 444; generating a plurality of distance keys corresponding to the elevation angular measurement data and to the predetermined target distances using the computer processor; making the plurality of distance keys corresponding to the elevation angular measurement data and to the predetermined target distances available to the user; selecting a first indicator pin 144 corresponding to a first of the plurality of distance keys; affixing the first indicator pin 144 to turret 144 at a first position, the first position defined by the elevation angular measurement data; selecting a second indicator pin 144 corresponding to a second of the plurality of distance keys; and affixing the second indicator pin 144 to turret 144 at a second position, the second position being defined by the elevation angular measurement data.

In an embodiment, and as described above, the distance keys may be defined by a group of colors, each color different from the other.

By means of such methods, a user or shooter may prepare turret 104 for use in the field based on system 440.

In another embodiment, a user may prepare a second turret 104 for use in the field. The second turret may be configured for use with ammunition, rifle, rifle barrel, or some other ballistics feature or characteristic that is different from those associated with a first turret 104. In one such embodiment, a first turret 104 is configured using the method described above to place indicator pins 144 onto a first indicator carrier 142 for ammunition of a first type. Second turret 104 is configured using the same method described above to place indicator pins 144 onto a second indicator carrier 142 based on a second ammunition type. In one such embodiment, a first ammunition type may be defined by a bullet having a first type, such as a first weight, while a second ammunition type may be defined by a bullet having a second type, such as a second, or different weight.

As such, a method of the present invention includes not only the method of configuring a turret 104 or indicator carrier 142 according to a first set of ballistics information, but also includes subsequently configuring a second turret 104 according to a second set of ballistics information. The method may also include a user exchanging indicator carriers 142 in the field based on whether a first or second set of ballistics information is to be used.

In one such embodiment, multiple reference cards 460 may be generated, one for the first set of ballistics, one for the second set of ballistics.

In an embodiment described below with respect to FIGS. 21-27, ballistic reference card 460 fits inside a round objective lens cover and is intended to be replaced, and swapped out, as ammunition, rifle setup or atmospheric conditions change, in order to provide a specific ballistic solution for any ammunition. The ammunition type and atmospherics chosen are also printed on the card or disk to remind the user what that reference card is used for, enabling fast and efficient changes between ammunition types, without having to repeat the turret setup. In an embodiment, ammunition load and atmospheric information is printed very small, so that non-critical information for making an in-field adjustment is not easily visible from behind riflescope 102. The characters and indicia 462 printed on ballistic reference card 460 showing the ammunition and atmospheric data is intentionally tiny, in an embodiment, so as to not distract the user from the needed information after ranging a target, namely a distance key or color and a wind MOA. The distance color (in yards or meters) and the windage MOA number are much larger, so the human eye naturally sees the dominant characters.

Figure 21:
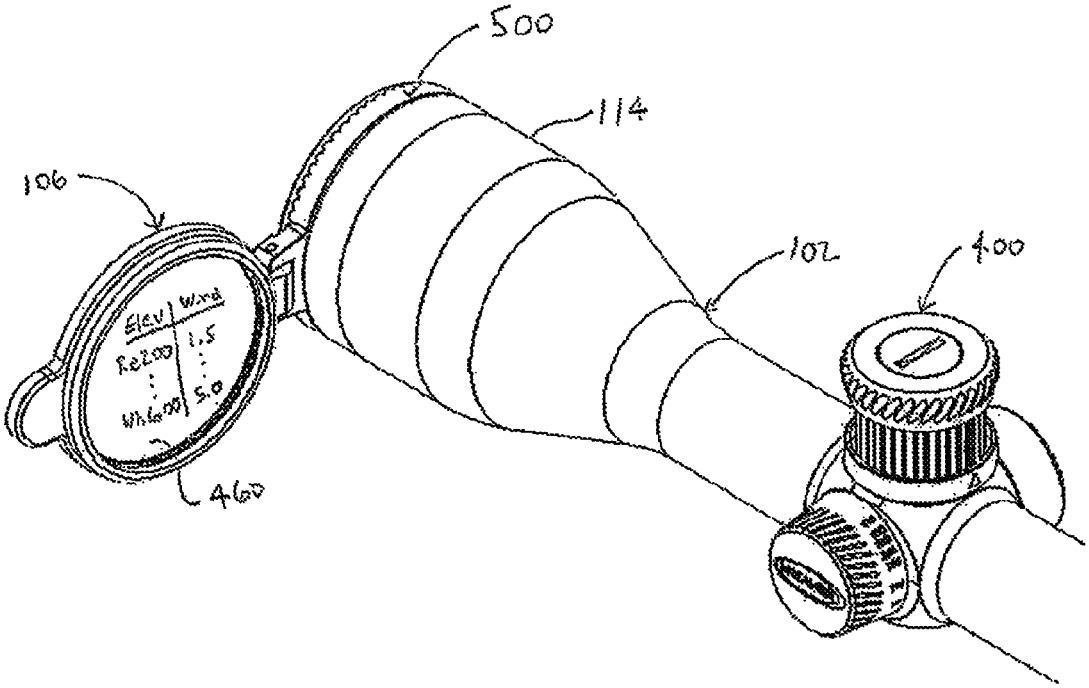
FIG. 21 is a right-side perspective view of a ballistics reference system mounted to a riflescope, according to an embodiment of the invention.
Figure 22:
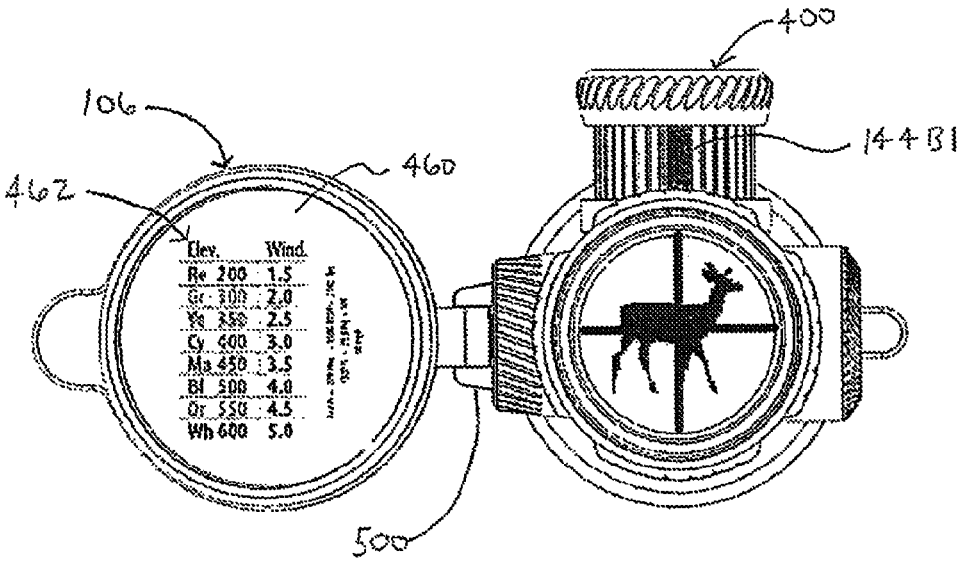
FIG. 22 is a rear perspective view of the ballistics reference system mounted to a riflescope of FIG. 21.

Referring to FIGS. 21 and 22, one or more ballistics reference cards 460 are placed into reference mounting system 500 of riflescope 102 to form ballistics reference system 106. Ballistics reference system 106 when combined with multiple-zero-point elevation turret 104, with its unique color-coding scheme, form riflescope aiming system 100.

FIGS. 21 and 22 depict ballistics reference system 106 in a viewable position. More specifically, FIG. 21 depicts a left-side perspective view of ballistics reference system 106, while FIG. 22 depicts the view from the perspective of a user or shooter. As depicted, and as will be described further below, the position of ballistics reference card 460 is easily viewed by a shooter while aiming, or preparing to aim, at a target. The quickly-referenced aiming system near the sight-line of the target and in close proximity to the shooters eyes and hands is highly ergonomic, saving time and eliminating the need to change shooting form. A goal of ballistics reference system 106 and riflescope aiming system 100 is to eliminate heat-of-the-moment calculations and thinking that distracts and delays the shooter in the seconds before shooting at a target animal. In an embodiment, and as described above, the turret 104 configuration is completed far ahead of the hunt, in a controlled, no-stress range scenario.

Figure 23:
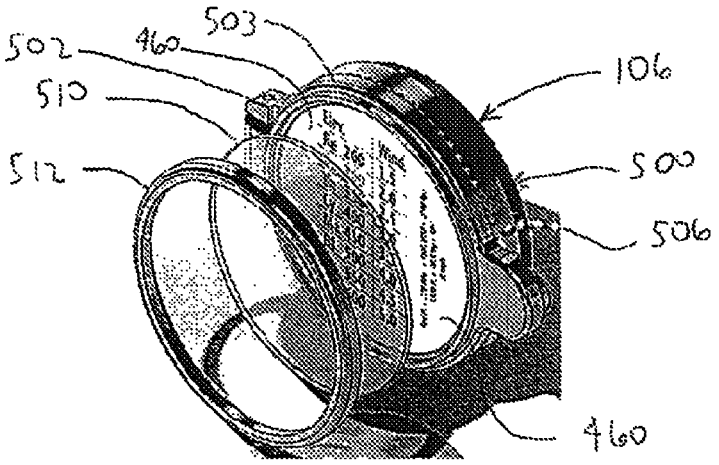
FIG. 23 is a front perspective view of the ballistics reference system in the stowed position, according to an embodiment of the invention.

FIG. 23 depicts ballistics reference system 106 in a stowed position, (with a base cap and lens removed, and detached, for the sake of illustration, from riflescope 102). FIG. 1 also depicts ballistics reference system 106 in a stowed position. As will be described further below, a shooter can quickly and easily manipulate ballistics reference system 106 from a stowed position to a viewable position.

Figure 24A:
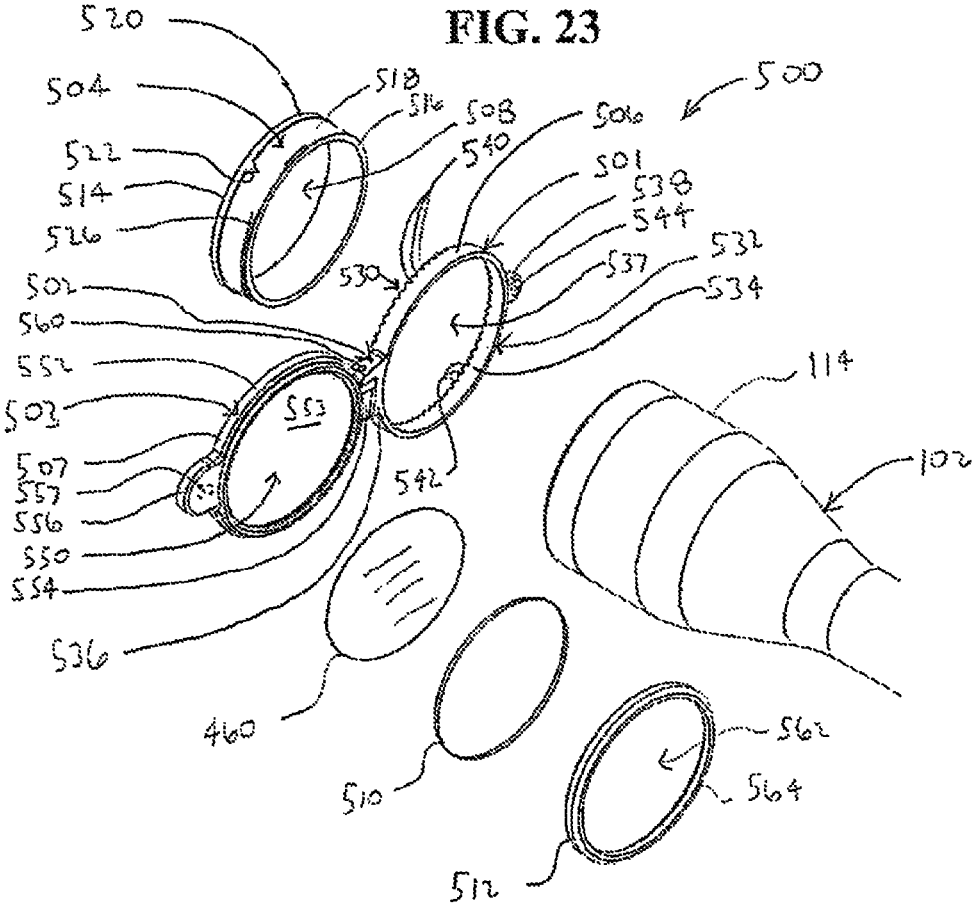
FIG. 24A is an exploded view of a ballistics reference system, according to an embodiment of the invention.
Figure 24B:
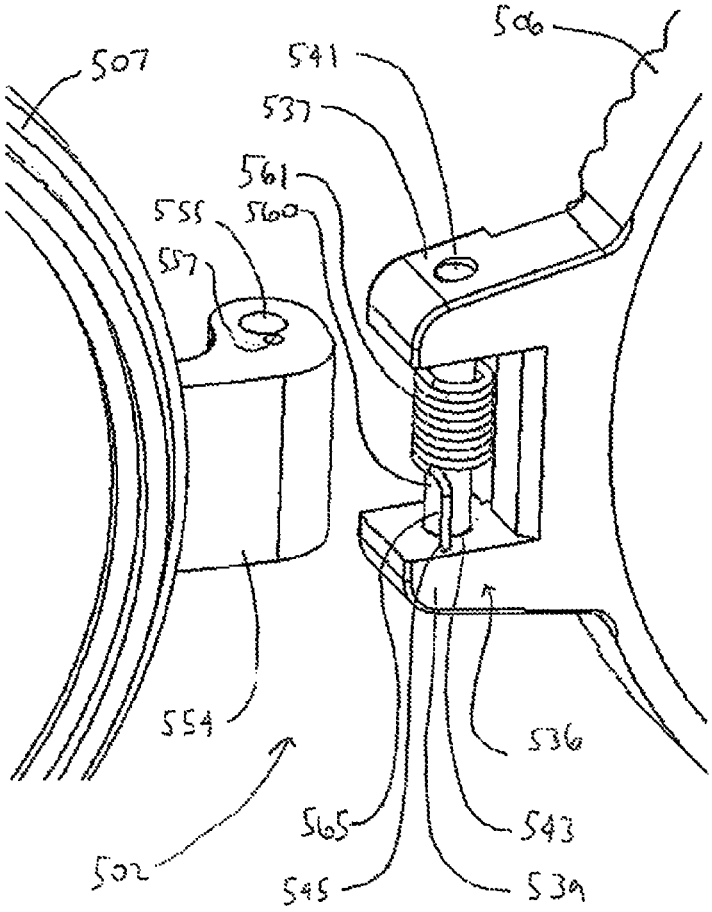
FIG. 24B is a top perspective view of a movement portion of the ballistics reference system of FIG. 24A, depicting a pin and spring attached to an inner ring, according to an embodiment of the invention.
Figure 24C:
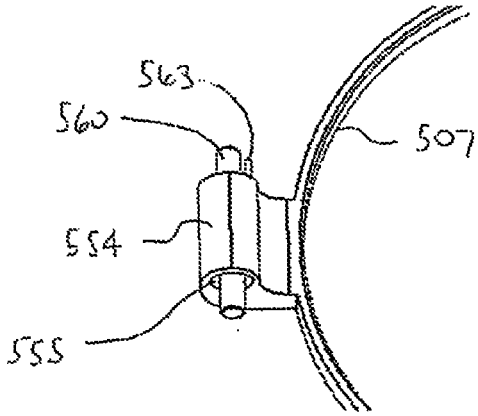
FIG. 24C is a bottom perspective view of the movement portion of FIG. 24B, depicting the pin and spring attached to a base portion, according to an embodiment of the invention.

Referring also to FIGS. 24A-24C, in an embodiment, reference mounting system 500 comprises a system and structure for coupling one or more ballistics reference cards 460 to riflescope 102 or to other portions of a rifle. In the depicted embodiment, reference mounting system 500 couples ballistics reference cards 460 to objective housing 114 of riflescope 102, incorporating a lens cover structure at an objective end of riflescope 102.

In an embodiment, reference mounting system 500 includes mounting portion 501, movement portion 502, and reference card holder 503.

Mounting portion 502 may include any of a variety of structures for mounting movement portion 504 and reference card holder 506 to riflescope 502. Such structures may comprise one or more rings, straps, frames, and so on for mounting reference card holder 503 with reference cards 460 and movement portion 502 to the rifle or firearm.

In an embodiment, mounting portion 502 comprises locking ring 504 and inner ring 506.

In an embodiment, locking ring 504 defines opening 508, and includes outside end 514, inside end 516, wall portion 518, flange portion 520, and indexing portion 522. In an embodiment, wall portion 518 at inside end 516 includes threads 526. Indexing portion 522, in an embodiment forms a triangular, or other "tooth-like" shape that is complementary to structure of inner ring 506, as described further below. Indexing portion 522 is adjacent to flange portion 520 on wall portion 518. Although locking ring 504 is depicted as including only a single indexing portion 522, it will be understood that locking ring 504 may include one or more indexing portions 522 distributed about wall portion 518.

In an embodiment, and as depicted, inner ring 506 includes outside end 530, inside end 532, wall 534, connection portion 536 and tab 538. Inner ring 506 defines opening 537.

Outside end 530 includes a plurality of indexing portions 540 defining a plurality of indexing recesses 542. In an embodiment, indexing portions 540 are tooth-like projections, and may form triangularly-shaped portions projecting axially about all or a portion of a perimeter of outside end 530 of inner ring 506. As depicted, each indexing recess 542 is defined by a pair of adjacent indexing portions 540. In an embodiment, and as will be described further below, each indexing recess 542 is configured to receive an indexing portion 522 of locking ring 504.

Connection portion 536, in an embodiment, and as depicted, projects radially from wall 534 of inner ring 506, forming a portion of hinge 508.

Tab 538 projects radially from wall 534, and in an embodiment, defines opening 544. Tab 538 may be located opposite connection portion 536, as depicted.

Ballistics reference card holder 503, in an embodiment, comprises base portion 507, protective lens 510, and outer ring 512. Generally, ballistics reference card holder serves as a container or containment system for one or more ballistic reference cards 460. In an embodiment, card holder 503 may be watertight or water resistant, providing protection to the one or more reference cards 460. In other embodiments, card holder 503 may include an open portion (not depicted) that allows a reference card 460 to be inserted easily into the holder, the open portion being exposed to the outside environment. In one such embodiment, the open portion may comprise a slot in base portion 507 through which a reference card 460 may be received.

In an embodiment, ballistics reference card holder 503 may conform to the shape of ballistics reference card 460, or vice versa. In one such embodiment, and as depicted, ballistics reference card 460 is generally circular, as is base portion 507 and ballistics reference card holder 503. In other embodiments, card 460 and holder 503 may comprise other shapes, such as a square, rectangle, and so on. In embodiments ballistics reference card 460 is conformal to the shape of ballistics reference card holder 503, as described above.

Figure 26:
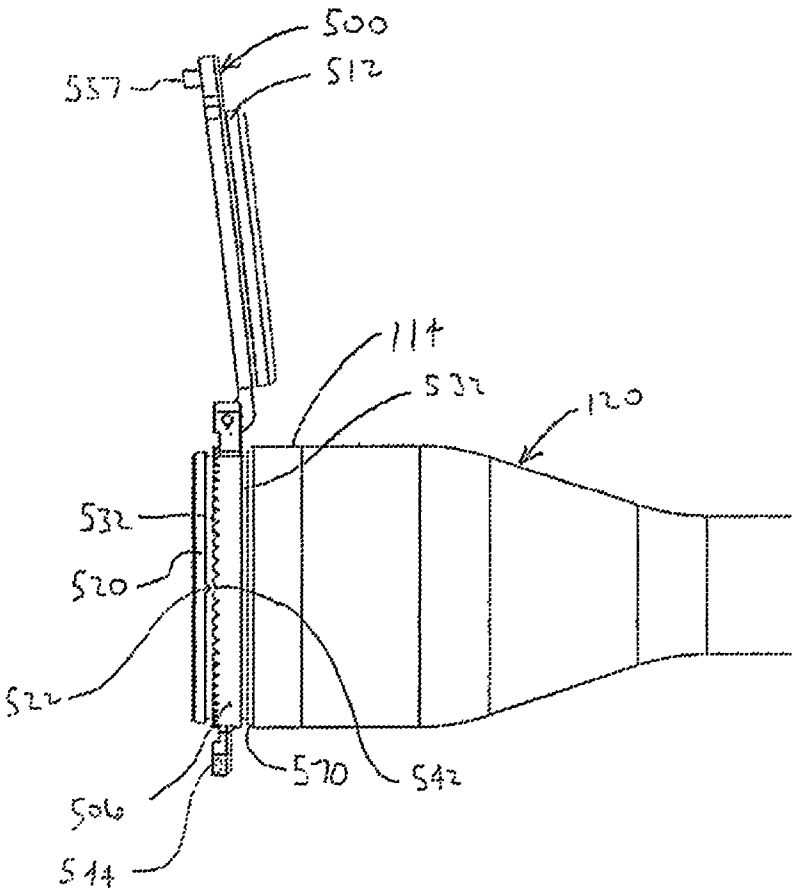
FIG. 26 is a top view of the ballistics reference system in a viewable position, the system loosely mounted to the scope.
Figure 25:
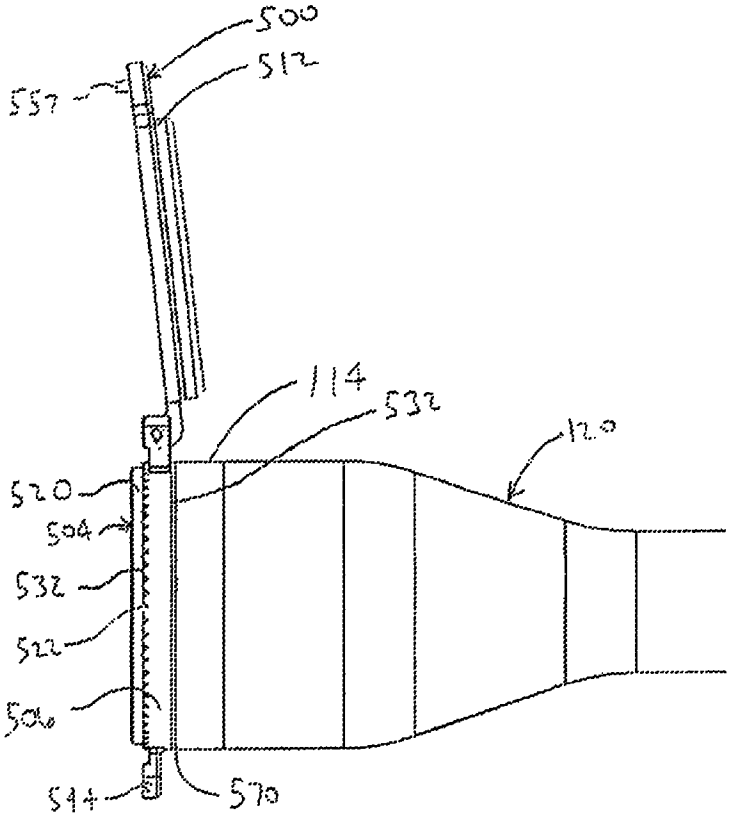
FIG. 25 is a top view of a ballistics reference system in a viewable position.

Base portion 507, in an embodiment, forms a disk, which may be beveled, and that defines card-receiving cavity 550. Base portion 507 in an embodiment includes perimeter wall 552, wall 553, connection portion 554, and tab 556. Perimeter wall 552 in combination with wall 553 forms card-receiving cavity 550. Connection portion 554 projects radially and may form a portion of movement portion 502. Tab 556 projects radially from wall 552, and in an embodiment, is located opposite connection portion 554. In an embodiment, tab 556 includes an projection 557 that may be received tightly by opening 544 of tab 538, thereby securing reference card holder 503 in a stowed or closed position. FIGS. 25 and 26 depict further details of projection 557 and opening 544.

Referring to FIG. 24B, movement portion 502 is depicted. Movement portion 502 may comprise a hinge, as depicted, or may generally comprise a flexible mechanism that allows pivoting of reference card holder 503 between a stowed position and a viewable position.

In an embodiment, movement portion 502 comprises a hinge that includes connection portions 536 and 554, as well as pin 560 and spring 561. FIG. 24B depicts base portion 507 detached from movement portion 502, and depicts pin 560 and spring 561 assembled to inner ring 506 at connection portion 536.

In an embodiment, spring 561 includes top portion 563 and bottom portion 565.

Connection portion 536 of inner ring 506 includes a top portion 537 and a bottom portion 539. Top portion 537 defines top hole 541; bottom portion 539 defines bottom hole 543 and spring anchor hole 545. When assembled, and as depicted, a top end of pin 560 is received into top hole 541 of top portion 537, and a bottom end of pin 560 is received into bottom hole 541. Bottom portion 565 of spring 561 is received by anchor hole 545.

Referring specifically to both FIGS. 24B and 24C, FIG. 24B is a top perspective view of movement portion 502 illustrating pin 560 and spring 561 assembled into connection portion 536, while FIG. 24C is a bottom perspective view of movement portion 502 illustrating pin 560 and spring 561 assembled into connection portion 554.

Connection portion 554 of base portion 507 is configured to be pivotably received by connection portion 536. More specifically, connection portion 554 is received in the space created between top portion 537 and bottom portion 539 of connection portion 536.

Connection portion 554, in an embodiment, defines pin-receiving channel 555 and anchor hole 557. When assembled, pin-receiving channel 555 receives pin 560 and spring 561. Top portion 563 of spring 561 is received by spring-anchor hole 557.

By anchoring top end 563 of spring 561 in spring-anchor hole 557 of connection portion 554 of base 507, and anchoring bottom end 565 of spring 561 in spring-anchor hole 545 of connection portion 536, spring 561 is secured in movement portion 502. In an embodiment, when base 507 is positioned fully away from inner ring 506, i.e., the viewable position, spring 561 may be unbiased. When base 507 is moved toward inner ring 506, a torsional force is exerted on spring 561. As such, base 507 is generally biased to the viewable position. Such a configuration makes it easy for a shooter to move base 507 from a stowed or closed position to a viewable or open position since spring 561 exerts a force on base 507, assisting in moving base 507 to the viewable position.

Referring again to FIG. 24A, in an embodiment, protective lens 510 comprises a transparent, clear or colored, covering. In an embodiment, protective lens 510 is generally circular, and shaped to fit over, or to cover, opening 550 of base portion 507. Reference card 460 may be fit into cavity 550, then be covered by protective lens 510.

Outer ring 512 is configured to couple to base portion 507, and in an embodiment defines opening 562, and includes flanged portion 564. In an embodiment, a portion of base portion 507, projection 557, snaps into a complementary recess of outer ring 512, cavity 544, or a portion of outer ring 512 snaps into a complementary recess of base portion 507; in another embodiment, a portion of outer ring 512 threads into a recess of base portion 507, or vice versa; in other embodiments, outer ring 512 and base portion 507 couple by other mechanical means.

In an embodiment, an outside diameter of protective lens 510 is slightly smaller than an inside diameter of outer ring 512, such that protective lens 510 may be received into opening 562 defined by outer ring 512, and held adjacent flange portion 564 of outer ring 512.

Referring to FIGS. 23 and 24, when assembled, one or more reference disks 460 are placed into opening 550 of base portion 507, and adjacent wall 553. Protective lens or cover 510 is placed over the one or more reference disks 460, such that an outside reference disk 460 is viewable through protective lens 460. Outer ring 512 is coupled to base portion 507, thereby capturing protective lens 460 and the one or more reference disks 460.

In an embodiment, cavity 550 is deep enough to securely accommodate a stack of reference disks 460. In such an embodiment, an outside, or displayed, reference disk 460 may be adjacent protective lens 510 and available for viewing. Other reference disks 460 may be stacked behind the outside reference disks, stored and secured inside cavity 550. A user may select which of a plurality of reference disks 460 to display or view, and which to stow or store.

Base portion 507 is hingedly coupled to inner ring 506 at hinge 508, such that base portion 507 pivots about pin 560. In the viewable position, as depicted in FIG. 19, base portion 507 extends radially away from objective housing 114. In the stowed, storage, or non-viewable position, as depicted in FIG. 18, base portion 507 is adjacent locking ring 504, such that wall 553 is generally parallel with objective lens 116 (see also FIG. 2).

Referring also to FIGS. 25-26, when assembled, inner ring 506 is coupled to objective housing 114 of scope 102. In the embodiment depicted, an end of objective housing 114 is received by opening 537 of inner ring 506, such that inner ring 506 is located on an outside surface of objective housing 114. In an embodiment, inner ring 506 is slidably coupled to objective housing 114, such that inner ring 506 may be rotated about objective housing 114, and moved axially along objective housing 114.

When fully seated onto objective housing 114, inside end 532 of inner ring 506 is adjacent and in contact with flanged portion 570 of objective housing 114, as depicted in FIG. 25. FIG. 26 depicts inner ring 506 not fully seated against flanged portion 570 of objective housing 114.

Locking ring 504 is coupled to objective housing 114. In an embodiment, wall 518 is inserted into an end of objective housing 114, with threads 526 engaging complementary threads of objective housing 114. Locking ring 504 may be thusly screwed or threaded into objective housing 114. When locking ring 504 is fully threaded into objective housing 114, flanged portion 520 at outside end of locking ring 504 abuts outside end 530 of inner ring 506, trapping inner ring 506 between flanged portion 520 of locking ring 504 and flanged portion 570 of objective housing 114. When locking ring 504 is fully received and threaded into objective housing 114, a position of indexing portion 520 is fixed relative to objective housing 114 and inner ring 506.

Further, when locking ring 504 is fully received and seated into objective housing 115, indexing portion 522 is received by one of indexing recesses 542 of inner ring 506. When indexing portion 522 is not received by one of indexing recesses 542, i.e., prior to locking ring 504 being fully received by objective housing 114, inner ring 506 may be rotated about objective housing 114. However, when locking ring 504 is fully received and seated, and when indexing portion 522 is received by one of indexing recesses 542, such that inner ring 506 is in contact with both flanged portion 520 of locking ring 504 and flanged portion 570 of objective housing 114, inner ring 506 is no longer able to rotate, and its position is fixed.

Consequently, the position of inner ring 506 on objective housing 114, which determines the relative orientation of base portion 507 and its contents reference disk 460 may be changed by loosening locking ring 504, disengaging indexing portion 522 from its receiving indexing recess 542, and rotating inner ring 506 about objective housing 114.

FIGS. 25 and 26 depict objective housing 114 in a bottom view, such that base portion 507 is located generally on a left side of objective housing 114, which is suitable for a right-handed shooter looking through scope 102 with a right eye. FIG. 24A is a top view, depicting the base portion 507 in the same relative position as depicted in FIGS. 25 and 26. FIG. 23 is a top view of system 500, with base portion 507 rotated 180°, which may be preferable for a left-handed shooter.

Ring 504 may be positioned in one of a plurality of predetermined rotational positions relative to objective housing 114. In an embodiment, and as depicted, the number of predetermined rotational positions is determined by the number of indexing recesses 542. In an embodiment, each indexing recess 542 is capable of receiving indexing portion 542. Consequently, the rotational position of reference disk system 500, and consequently the position of reference disk 460 may be varied based on the rotational position of locking ring 504.

Figure 27:
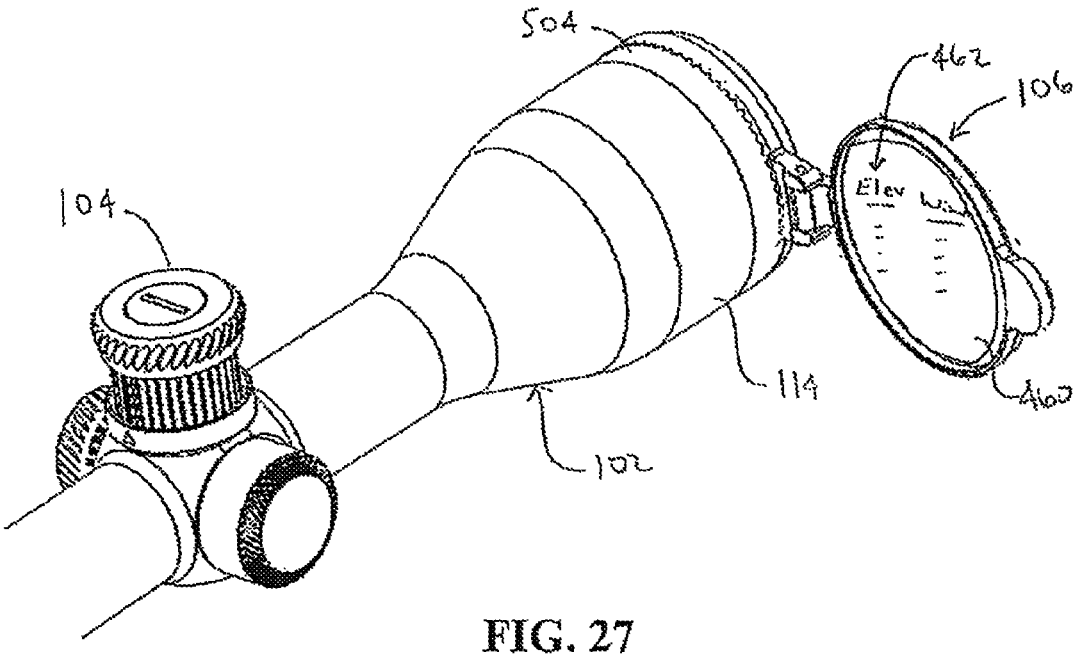
FIG. 27 is a perspective view of the ballistics reference system of FIGS. 25 and 26, but rotated to an opposite side.

Referring also to FIG. 27, ballistics reference system 106 is depicted as positioned for a left-handed shooter. In this position, indicia 462 are readable on a right side of scope 102, rather than a left side as depicted in FIG. 24A, after rotation of inner ring 506.

As such, in an embodiment, a method of the invention includes: placing an inner ring of a ballistics reference system onto an objective housing, engaging a locking ring with the objective housing at a non-locking position, rotating the inner ring to a rotational position such that a reference disk coupled to the inner ring is in a first orientation, further engaging the locking ring with the objecting housing to cause the locking ring to be in a locking position and to cause a indexing portion of the locking ring to be received by a first indexing portion of the inner ring, thereby locking the inner ring and the reference disk in the first rotational orientation or position.

In another embodiment, the method may also include loosening the locking ring to the non-locking position, rotating the inner ring to a second position, causing the locking ring to be moved to the locking position such that the indexing portion of the locking ring is received by the second indexing portion of the inner ring, thereby locking the inner ring and the reference disk in the second rotational orientation or position.

In addition to mounting system 500 being configurable to move reference disk 460 to any of a number of predetermined rotational positions, mounting system 500, and ballistics reference system 106 may be located at positions other than objective housing 114 of riflescope 102.

Figure 28:
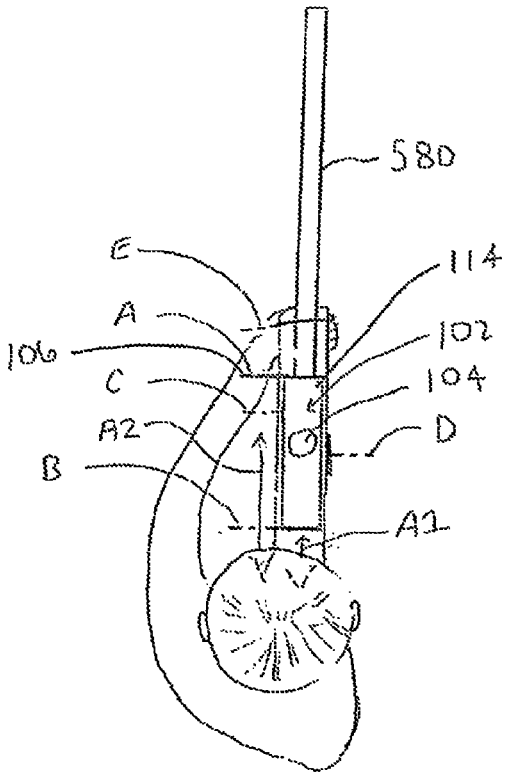
FIG. 28 is a top view of a shooter using an aiming reference system, according to an embodiment of the invention.

Referring to FIG. 28, a top view of a shooter aiming rifle 580 is depicted. Several possible positions of ballistics reference system 106 are depicted. Position A is the position described above, with ballistics reference system 106 being mounted to scope 102 at an objective housing 114. However, a number of alternate locations or positions are possible, including Positions B, C, D and E as depicted in dashed lines.

At Position B, reference system 106 is coupled to scope 102 at an end opposite objective housing 114, such as at an eyepiece of scope 102. In such an embodiment, ballistics reference system 106 may couple to scope 102 in a manner similar to that described with respect to Position A, only system 106 may be coupled to the eyepiece, rather than the objective housing.

At Position C, ballistics reference system 106 may be coupled to a scope mount or saddle that is affixed to rifle 580, rather than directly to scope 102.

At Position D, ballistics reference system 106 may be coupled to the stock of rifle 580, or to some other portion of rifle 580.

At Position E, ballistics reference system 106 may be coupled to rifle 580 near an end of a forestock of rifle 580.

Other embodiments of riflescope aiming system 100 and/or ballistics reference system 106 include mounting of the various systems at Positions A-D, as well as other positions, which may include a rifle barrel, other parts of scope 102 not expressly identified above, and other such portions and parts of scope 102 and rifle 580.

Still referring to FIG. 28, Arrow A1 illustrates the direction of view of a shooter looking through a right eye into scope 106. Often, a shooter will close the other eye, the left eye in this case, while looking into scope 102 and aiming rifle 580. Such a shooter may choose to use this same eye, the right eye in this case, to quickly view ballistics reference system 106, along the vector indicated by Arrow A2. Although some movement of the shooters head may be required, depending on the position of the shooter, only minimal movement is required, allowing the shooter to quickly alternate viewing reference disk 460 and the target through scope 102. Alternatively, a shooter may choose to use the non-aiming eye to view reference disk 460, as indicated by Arrow A2. In such a case, a shooter may even more quickly be able to refer to ballistics reference system 106, followed by adjustment of turret 104 with only very minimal movement or position change.

Figure 29:
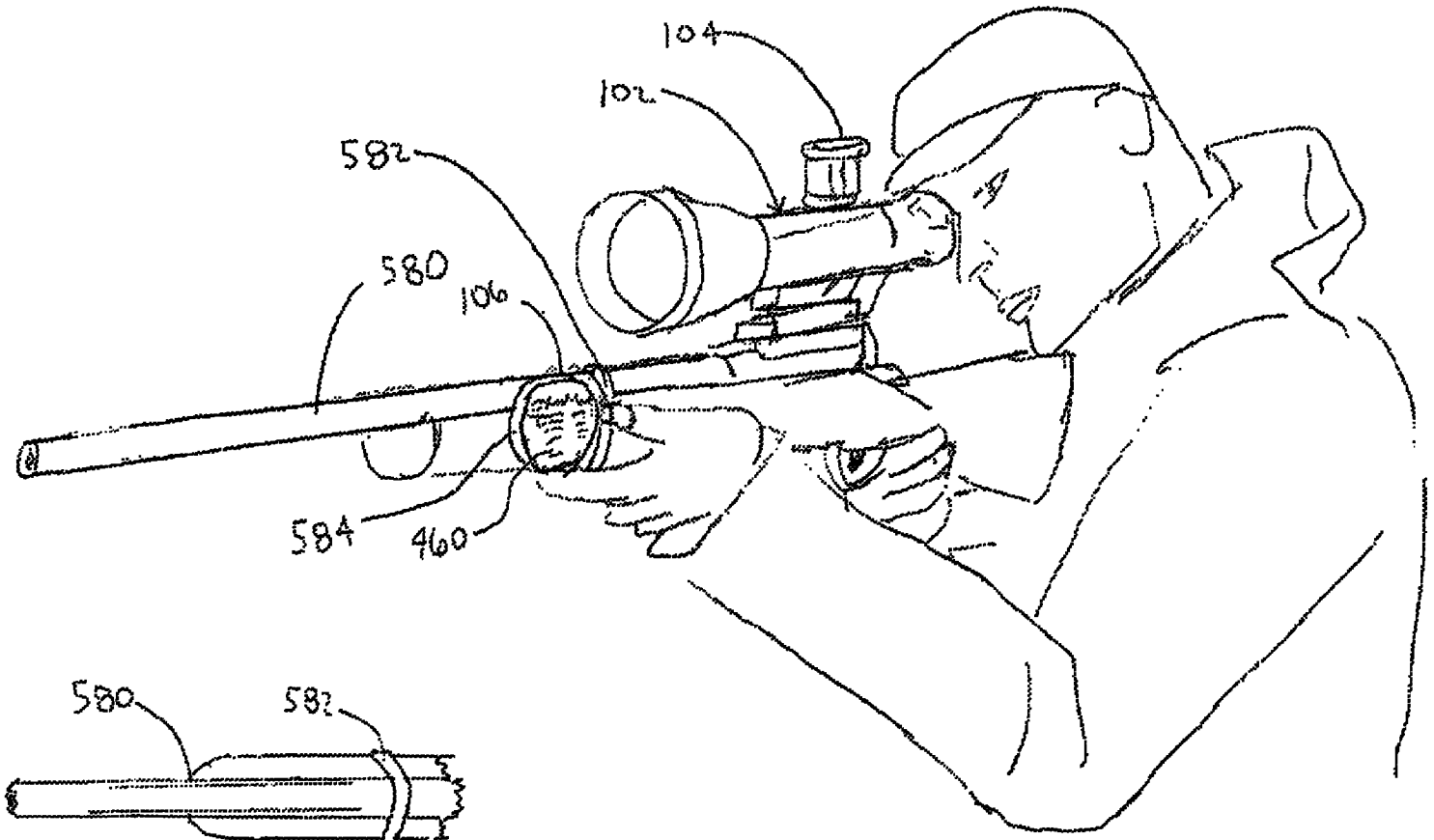
FIG. 29 is a perspective view of a shooter using an aiming reference system attached to a rifle at an alternate location, the aiming reference system in a stowed position.
Figure 30:
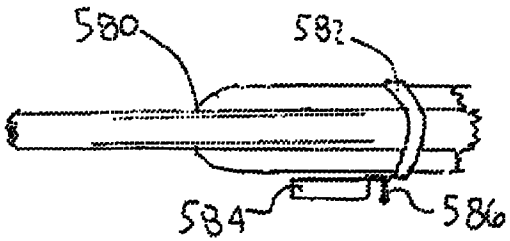
FIG. 30 is a top view of a the rifle and aiming reference system of FIG. 29.

Referring to FIGS. 29 and 30, a shooter aiming rifle 580 having an embodiment of ballistics reference system 106 attached at a forestock of rifle 580 is depicted. The position of ballistics reference system 106 as depicted is similar to Position E of FIG. 28.

Referring specifically to FIG. 29, ballistics reference system 106 is depicted in a stowed position. Ballistics reference system 106 is attached to rifle 580 at the forestock of the rifle, adjacent the portion of rifle 580 that a shooter grasps when aiming. The location of ballistics reference system 106 makes it easy for the shooter to swing or otherwise move ballistics reference 106 and its ballistic reference disk from the depicted stowed position to a viewable position (see FIGS. 31 and 32).

Referring also to FIG. 30, in this embodiment, ballistics reference system 106 includes mounting portion 582, such as a strap or band, reference card holder 584, and movement portion 586, which may comprise a hinge, as well as one or more ballistics reference disks 460.

Holder 584 holds one or more reference disks 460 in a manner similar to that described above. Holder 584 may comprise a frame-like structure as depicted, and/or may also comprise the structures described above, including base portion 507, lens 510, and outer ring 512. In the depicted embodiment, mounting frame 584 is secured to rifle 580 via band 582. Mounting frame 584 is connected to hinge 586; hinge 586 is connected to band 582. Hinge 586 allows mounting frame 584 with reference disks 460 to be pivoted about a hinge pin, and swung outwardly and away from rifle 580 into a viewable position.

In an alternate embodiment, holder 584 is coupled to rifle 580 at a hinge or other connection point using structure other than band 582. In one such embodiment, hinge 586 is connected means of a fastener, such as a screw, to rifle 280 forestock. Other means for pivotably connecting mounting frame 584 to rifle 580 comprise embodiments of the invention.

Figure 31:
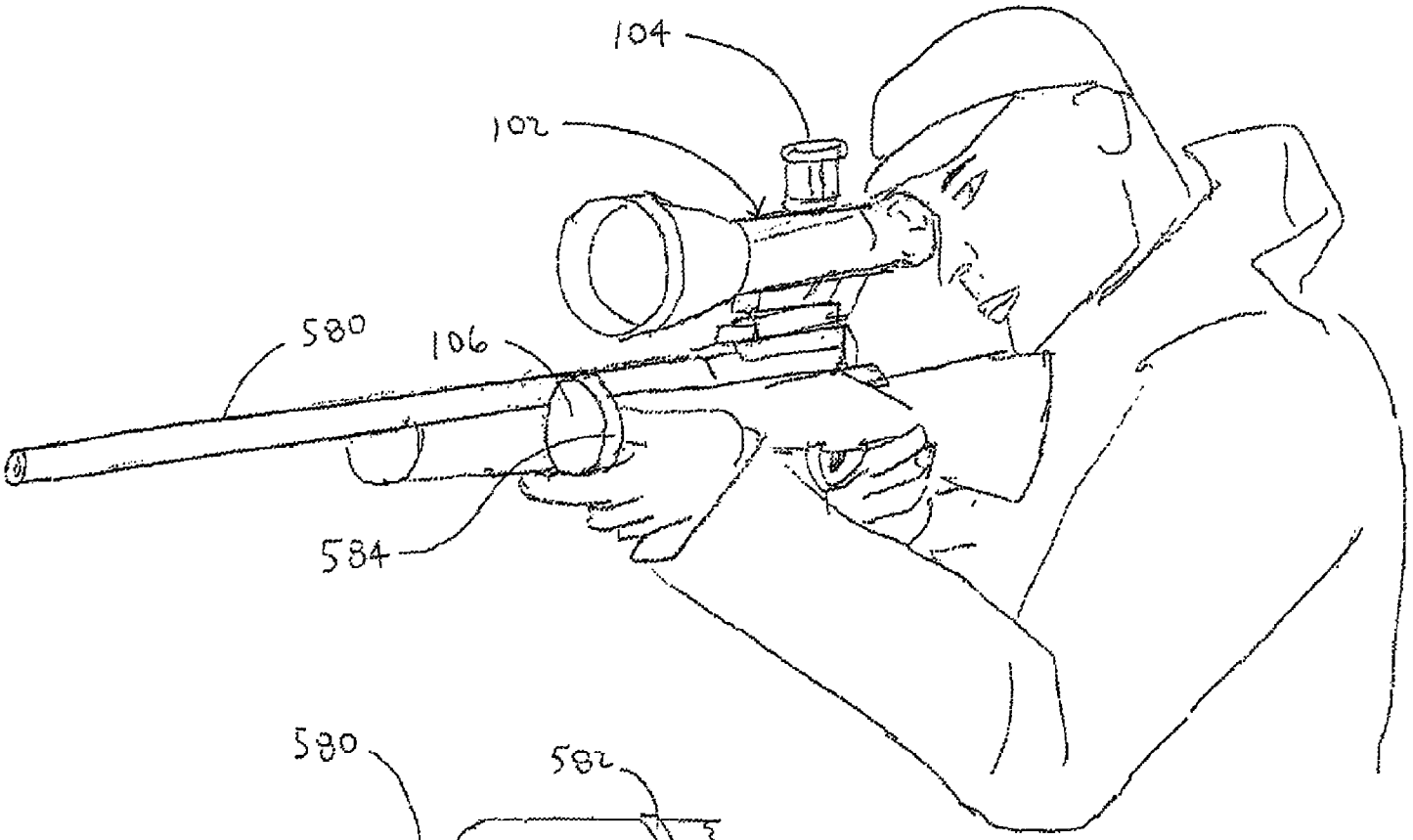
FIG. 31 is a perspective view of a shooter using an aiming reference system attached to a rifle at an alternate location, the aiming reference system in a viewable position.
Figure 32:
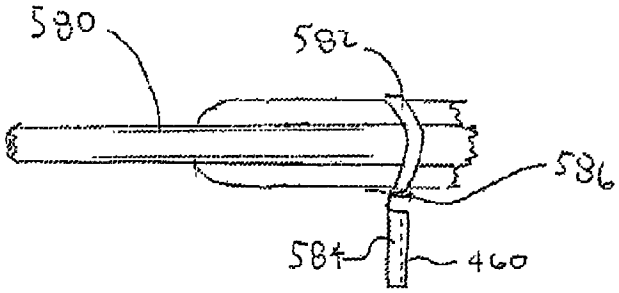
FIG. 32 is a top view of a the rifle and aiming reference system of FIG. 31.

Referring to FIGS. 31 and 32, ballistics reference system 106 is depicted in a viewable position. As depicted, reference disk 460 and holder 584 are moved to a position such that reference disk 460 is viewable to the shooter.

Mounting ballistics reference system 106 on the forestock of rifle 580 near a location where a shooter grips the forestock or rifle means that the shooter does not have to move his or her hand very far to change system 106 from a stowed to a viewable position. In an embodiment, a shooter may only have to use a single finger, such as an index finger, to manipulate holder 584 to swing it toward and away from rifle 580.

Further, the other fingers not used to manipulate ballistics reference system 106 may continue to grip rifle 580.

Further methods of using ballistics reference system 106 are described further below.

Figure 33:
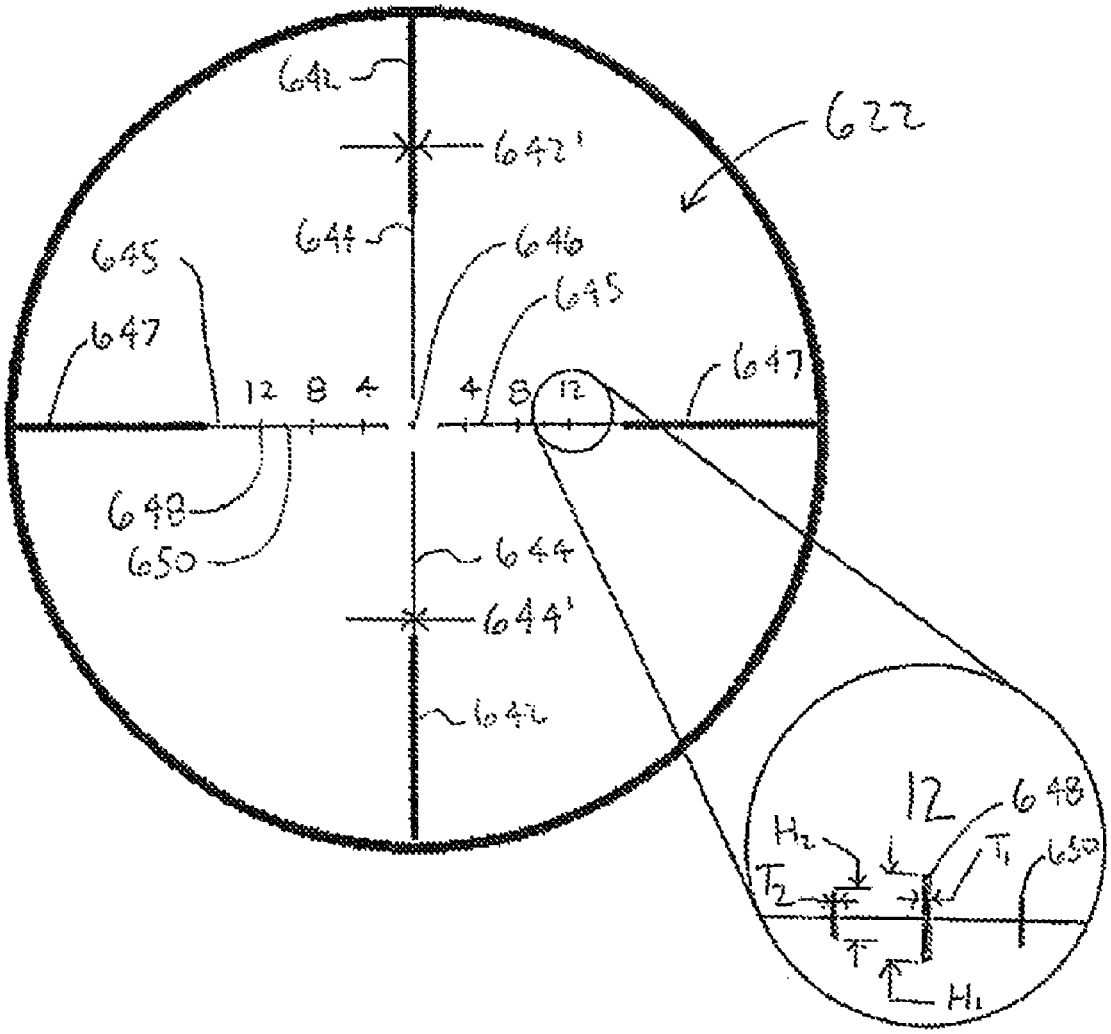
FIG. 33 is depiction of an indexed reticle pattern, according to an embodiment of the claimed invention.

Referring to FIG. 33, in an embodiment, riflescope aiming system 100 also includes an indexed or calibrated reticle system 622.

Generally speaking, and as understood by those skilled in the art, the intersection of crosshairs or the dot located in the center of a reticle represents the optical center, or point of aim. Furthermore, most riflescopes, including telescopic sight 102, provide variable levels of magnification in order to allow a user to zoom in on targets at various distances.

As described above, when shooting at long distances, shooters must adjust their aim to take into account the downward acceleration on the projectile imparted by gravity, which is often referred to as "bullet drop." This is typically done by adjusting the angular position of the riflescope relative to the rifle barrel using an elevation turret. Furthermore, shooters must adjust their aim to take into account lateral acceleration on the projectile imparted by wind, which is often referred to as "windage." Riflescope aiming system 100 not only includes multiple-zero-point elevation turret 104 to control the vertical elevation of the reticle, but may also include systems and information for quickly and easily making a wind hold adjustment to control the lateral adjustment of the reticle.

Indexed reticle 622, according to an embodiment of the invention is depicted. Indexed reticle 622 includes collinear thin vertical posts 642 and thick vertical posts 644; collinear thin horizontal lines 645 and thick horizontal lines 647. The hypothetical intersection of lines 645 and 644 defines optical center 646.

Any of posts 642, 644, or lines 645 and 647 may include indicia. Indicia on posts 642, 644 may be used to adjust elevation; indicia on lines 645, 647 may be used to adjust wind hold. In this embodiment, only thin horizontal lines 645 include indicia, specifically, wind hold adjustment indicia.

In the depicted embodiment, indexed reticle 622 is calibrated or scaled to include wind hold adjustment indicia, which in an embodiment may be represent adjustments measured in of minutes of angle, or MOA, or in other measurement scales or systems as described above. In the depicted embodiment, two different sized indicia in the form of lines or marks indicate wind hold adjustments. The first, larger size, or "major" line indicia, also referred to as stadia marks are indicated using reference numerals 648. Smaller or minor stadia marks are indicated using reference numerals 650.

For the sake of explanation, the term "MOA" will be used to refer to measures of wind hold and elevation indicia or marks depicted in FIG. 33, though it will be understood that the indicia may be measured using other measurement systems and criteria, e.g., metric, MilRad, etc. The measurement of a given MOA on the reticle indicates the elevation or windage adjustment, depending on whether the measurement is vertical or horizontal, so as to adjust the placement of optical center 646 relative to the target.

Indexed reticle 622 provides various tools for making rapid wind hold or windage adjustments without having to adjust windage turret 124 (see FIG. 1). In an embodiment, each portion of each line comprising the crosshairs and stadia marks have scaled thicknesses or widths and in some cases heights that are predetermined and scaled to correspond to predetermined measurements.

With respect to indexed reticle 622, according to this particular example embodiment, posts 642 have a scaled or calibrated thickness 642', which corresponds to a predetermined measurement adjustment, or MOA, such as 0.7 MOA; thin lines 644 have thickness 644', which corresponds to, for example, 0.2 MOA; and the optical center dot 646 has diameter which corresponds to 0.5 MOA.

Furthermore, the horizontal primary lines 645 include a plurality of major tick marks or stadia 648 and minor tick marks 650, which have a scaled height and thickness of $H_1 \times W_1$ and $H_2 \times W_2$, respectively, which on this particular example reticle 622 correspond to 0.2 MOA×0.1 MOA and 0.2 MOA×0.5 MOA, respectively.

In an embodiment, because all indicia are scaled relative to one another, thicknesses, heights, and relative sizes can quickly be viewed used to make adjustments with minimal calculation or decision making.

The wind hold adjustment measurements taken from the indexed reticle 622 can be very helpful with respect to making minor manual elevation and windage adjustments; however, these measurements require visual estimation and may be best suited for small fine-tuning adjustments.

In an embodiment, indexed reticle 622 can be used in conjunction with ballistics reference system 106 to make rapid wind hold adjustments. Referring also to reference disk 460 of FIG. 20, at 200 yards, a windage adjustment is 1.5 MOA for a 10 mph wind. Although windage turret 124 could be used to make the adjustment for wind, such that optical center dot 646 is held on target with respect to horizontal adjustment, alternatively, optical center dot 646 could be moved horizontally by 1.5 MOA, such that optical center dot 646 is 1.5 MOA from the center of the intended target. Such a simple movement of scope 102 is generally much faster than making an adjustment via a windage turret.

In combination, aiming reference system 100 with its ballistics reference system 106, multiple-zero-point elevation turret 104, and calibrated reticle 622 allow a user to rapidly and effortlessly access ballistics information and aim rifle 580 at a target quickly and easily at any distance.

Figure 34:
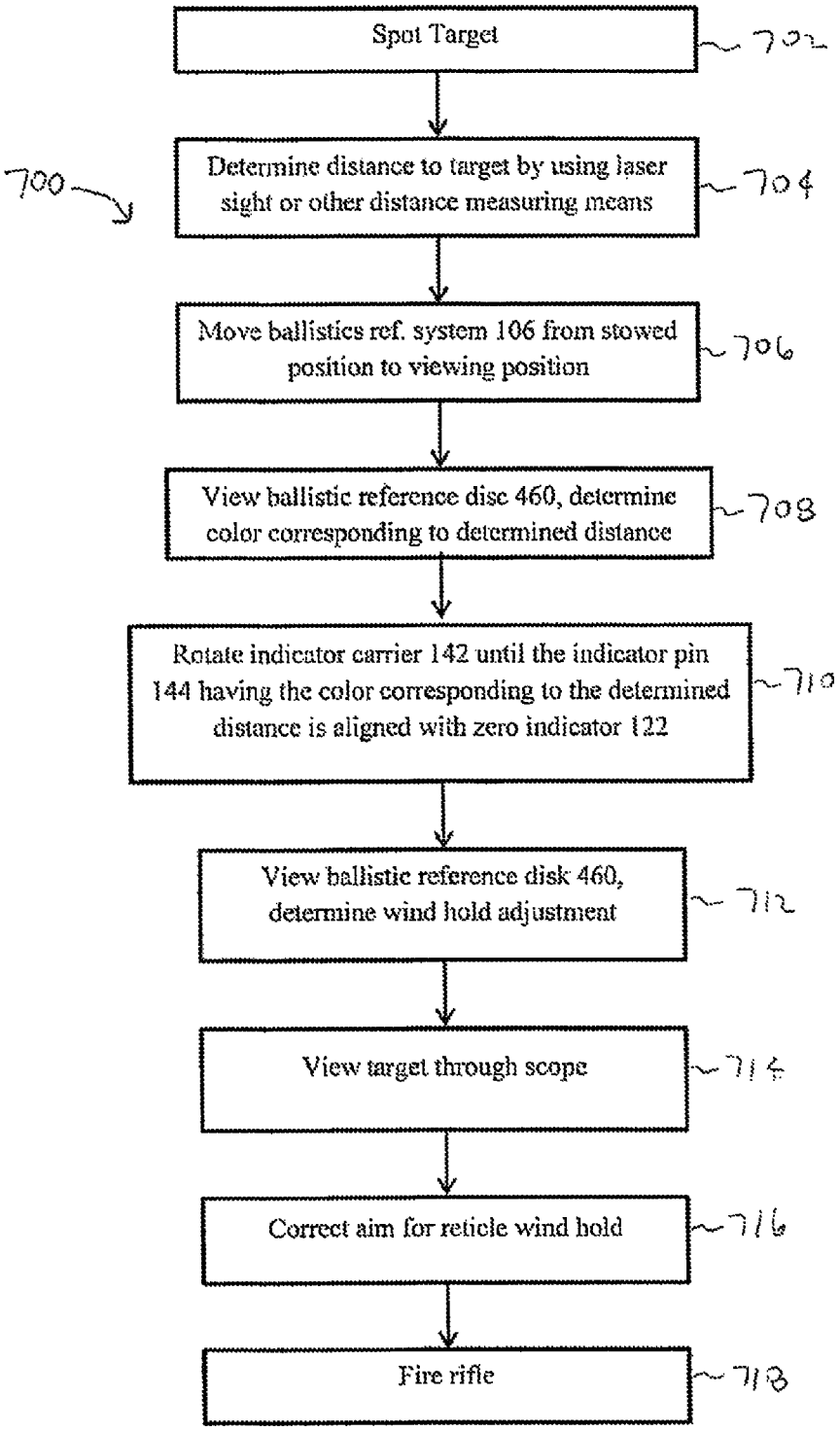
FIG. 34 is a flow diagram of a process of using the riflescope aiming system of FIG. 1, according to an embodiment of the claimed invention.

Referring to FIG. 34, in an embodiment, the invention includes a method 700 of using riflescope aiming system 100. Although a number of steps are depicted and described, it will be understood that many steps are optional, depending on whether all aspects of system 100 are employed during a particular event.

At step 702, a shooter spots or identifies a target.

At step 704, the shooter estimates a distance to a target, or determines a distance to the target by using a laser sight or other distance measuring means.

At step 706, the shooter moves ballistic reference system 106 from a stowed position to a viewable position.

Next, at step 708, the shooter checks the ballistic reference disk, quickly matching the estimated distance to an indicator pin color.

At step 710, the shooter rotates indicator carrier 142 until the colored indicator pin corresponding to the distance is aligned with zero indicator 200 on telescopic sight 102.

At optional step 712, the shooter again views ballistic reference disk to determine a wind hold adjustment. Alternatively, step 712 may be combined with step 708.

At step 714, the shooter views the target through scope 102.

At step 716, the shooter aims, correcting for the reticle wind hold.

At step 718, the shooter fires the rifle at the target.

Figure 35:
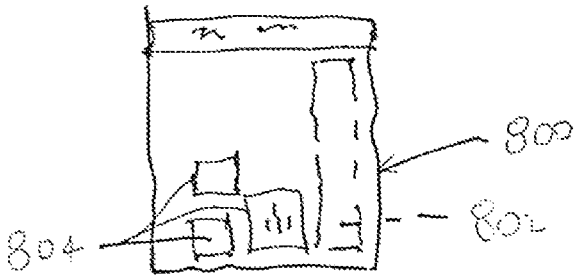

Referring to FIG. 35, packaging 800 may include instructions 802, and components 804 as described above, such as indicator carriers, riflescopes, indicator markers or pins, ballistic reference cards, ballistic reference systems, and so on. The instructions may include the use, install, and ballistics download instructions as described above. Such packaging 800 may constitute or comprise a kit.

Consequently, embodiments of the claimed invention include, but are not limited to, a riflescope aiming system, a multiple-zero-point elevation turret for a riflescope, ballistics reference system for a riflescope, a calibrated reticle pattern for a riflescope and a method of aiming a riflescope having a multiple-zero-point elevation turret.

In an embodiment, the invention comprises: riflescope aiming system, comprising: a telescopic sight including a cylindrical body having an ocular housing carrying an ocular lens system at a first end and an objective housing carrying an objective lens system at a second end, and housing an erector assembly having an erector tube and a reticle; a multiple-zero-point elevation turret mounted to the cylindrical body and operably coupled to the erector assembly, the multiple-zero-point elevation turret including a rotatable indicator carrier and a plurality of indicator pins secured to the indicator carrier, each indicator pin corresponding to a predetermined target distance, the adjustable indicator carrier coupled to the erector assembly such that a rotation of the indicator carrier causes a reticle position to be adjusted; an aiming reference system operably coupled to the objective housing and displaying aiming reference data, the aiming reference data including a target distance and an indicator-pin identifier identifying the one of the plurality of indicator pins corresponding to the target distance.

In an embodiment, the invention comprises a multiple-zero-point elevation turret for a riflescope, comprising: an indicator carrier configured to be rotatably coupled to the riflescope, the indicator carrier defining a plurality of axially extending indicator-pin channels distributed about a circumference of the indicator carrier; and a plurality of indicator pins, each indicator pin corresponding to a predetermined target distance and including a key portion and a visual index portion, each key portion being received by an indicator pin channel such that the indicator pin is secured to the indicator carrier, and the visual index portion presents an index surface; wherein the alignment of the indicator pin with a stationary zero-index mark indicates that the riflescope aiming is adjusted to correspond to the predetermined target distance.

In an embodiment, the invention comprises an aiming reference system for a riflescope, comprising: a reference card operably coupled to the riflescope and movable between a first position and a second position; reference data indicia displayed on a surface of the reference disk, the reference data including a plurality of distance indicia, the distance indicia indicating a target distance and a unique identifier corresponding to a zero-point setting of an elevation turret; wherein the reference data indicia are viewable in the first position.

In an embodiment, the invention comprises an indexed reticle pattern for a riflescope, comprising: a scaled horizontal cross hair having a plurality of evenly spaced stadia markings, the cross hair having a known, uniform width defined in minutes of angle (MOA), each stadia marking having a known, uniform width and height, and a distance between stadia markings being uniform, each of the width, height, and distance measured in minutes of angle (MOA); and a scaled vertical cross hair intersecting the scaled horizontal cross hair and having a plurality of evenly spaced stadia markings, the cross hair having a known, uniform width defined in minutes of angle (MOA), each stadia marking having a known, uniform width and height, and a distance between stadia markings being uniform, each of the width, height, and distance measured in minutes of angle (MOA); wherein the stadia markings provide a reference index for adjusting an optical center of the riflescope.

In an embodiment, the invention comprises a method of aiming a riflescope having a multiple-zero-point elevation turret, comprising: estimating a distance to a target; viewing a ballistics reference card coupled to the riflescope, including viewing a plurality of reference distances and a plurality of unique identifiers associated with the plurality of references distances; matching the estimated distance to the target to one of the plurality of reference distances and a unique identifier associated with the reference distance; adjusting a setting of the multiple-zero-point elevation turret based on the unique identifier; and viewing the target through the riflescope.

In an embodiment, the invention comprises a multiple-zero-point elevation turret for a riflescope, comprising: an indicator carrier configured to be rotatably coupled to the riflescope, the indicator carrier including a top portion and a bottom portion and defining a central axis; a gripping cap operably coupled to the top portion of the gripping cap, the gripping cap including a perimeter lip, the perimeter lip extending axially downward from the top portion of the gripping cap; a base receiving the bottom portion of the indicator pin carrier, the base including a stationary zero-mark indicator; and a plurality of indicator pins distributed about a perimeter of the indicator pin carrier, each indicator pin extending axially from the top portion of the indicator pin carrier to the bottom portion of the indicator pin carrier, a top portion of each indicator pin being covered by the perimeter lip of the gripping cover, thereby securing the top portion of the indicator pin to the top portion of the indicator pin carrier, a bottom portion of each indicator pin being covered by the turret base, and a middle portion of each indicator pin remaining uncovered, each indicator pin corresponding to a predetermined target distance; wherein an alignment of an indicator pin with the stationary zero-mark indicator indicates a zero point of the rifle for the predetermined target distance corresponding to the aligned indicator pin.

In an embodiment, the invention comprises a combination rifle with a riflescope and a ballistic reference card mounting system, the combination comprising: the rifle with a stock, a forestock, and a barrel; the riflescope mounted to the barrel, the riflescope comprising a turret with rotatable indicator carrier with a plurality of indicator markers associated therewith and a rotatable gripping cap positioned above the rotatable indicator carrier; and the ballistic card mounting system comprising a card holder, a movable portion attached to the card holder, and an attachment portion for attachment to the scope or rifle, the movable portion providing a stow position for the card holder whereby a card therein is not viewable by a user of the firearm in ready to shoot position looking through the scope and a viewable position where the card therein is viewable by the user of the firearm in ready to shoot position looking through the scope.

In an embodiment, the invention comprises a riflescope for a rifle, the riflescope comprising a turret with rotatable indicator carrier with a plurality of indicator markers associated therewith and a rotatable gripping cap positioned above the rotatable indicator carrier; and a ballistic card mounting system comprising a card holder, a movable portion attached to the card holder, and an attachment portion attached or attachable to a forward portion of the riflescope, the movable portion providing a stow position for the card holder whereby the card holder covers an objective lens of the rifle scope and wherein a card therein is not viewable by a user of the firearm in ready to shoot position looking through the scope and a viewable position where a card therein is viewable by the user of the firearm in ready to shoot position looking through the scope.

In an embodiment, the invention comprises a rotatable indicator carrier with a plurality of indicator markers associated therewith and a rotatable gripping cap positioned above the rotatable indicator carrier for a riflescope attached to a rifle; and a ballistic card mounting system comprising a card holder, a movable portion attached to the card holder, and an attachment portion attachable to a forward portion of a riflescope or rifle, the movable portion providing a stow position for the card holder whereby a ballistic card therein is not viewable by a user of the firearm in ready to shoot position looking through the scope and a viewable position where a card therein is viewable by the user of the firearm in ready to shoot position looking through the scope.

In an embodiment, the invention comprises a combination rifle with a riflescope and a ballistic reference card mounting system, the combination comprising: the rifle with a stock, a forestock, and a barrel; the riflescope mounted to the barrel, the riflescope comprising a turret with plurality of interchangeable indicator carriers, each indicator carrier having a plurality of movable indicators thereon representative of yardage distances, and a rotatable gripping cap positioned above the rotatable cylindrical portion.

The above references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. A combination rifle with a riflescope and a ballistic reference card mounting system, the combination comprising:

the rifle with a stock, a forestock, and a barrel;

the riflescope mounted to the barrel, the riflescope comprising a turret with rotatable indicator carrier with a plurality of indicator markers associated therewith and a rotatable gripping cap positioned above the rotatable indicator carrier, wherein the indicator markers are removable and are each color coded;

a ballistic reference card having data comprising distances correlating to colors of the indicator markers; and the ballistic card mounting system comprising a card holder for receiving the ballistic reference card, a movable portion attached to the card holder, and an attachment portion for attachment to the scope or rifle, the movable portion providing a stow position for the card holder whereby the card therein is not viewable by a user of the firearm in a ready to shoot position and a viewable position where the card therein is viewable by the user of the firearm in the ready to shoot position.

2. The combination rifle and riflescope and ballistic reference card mounting system of claim 1 wherein the data comprising distances is displayed on the ballistic reference card in colors corresponding to colors of the plurality of indicator markers.

3. The combination rifle and ballistic reference card mounting system of claim 1, further comprising a plurality of indicator carriers each with a plurality of indicator markers respectively associated therewith.

4. The combination rifle and ballistic reference card mounting system of claim 3 wherein each of the indicator carriers is associated with different ammunition.

5. The combination rifle and ballistic reference card mounting system of claim 1, wherein the attachment portion is attached to a forward portion of the rifle scope.

6. A riflescope for a rifle, the riflescope comprising:

a turret with rotatable indicator carrier with a plurality of indicator markers associated therewith and a rotatable gripping cap positioned above the rotatable indicator carrier, wherein the indicator markers are removable and are each color coded;

a ballistic reference card having data comprising distances correlating to colors of the indicator markers; and a ballistic card mounting system comprising a card holder for receiving the ballistic reference card, and an attachment portion attached or attachable to a forward portion of the riflescope, the movable portion providing a stow position for the card holder whereby the card holder covers an objective lens of the rifle scope and wherein the card therein is not viewable by a user of the firearm in a ready to shoot position and a viewable position where the card therein is viewable by the user of the firearm in the ready to shoot position.

7. The riflescope of claim 6 packaged and further comprising instructions for downloading and printing ballistic information for the ballistic reference card to be received in the card holder.

8. The rifle scope of claim 6 further comprising packaging enclosing the instructions and riflescope.

9. An indicator and ballistic card mounting system for a riflescope, comprising:

a rotatable indicator carrier with a plurality of indicator markers associated therewith and a rotatable gripping cap positioned above the rotatable indicator carrier for a riflescope attached to a rifle, wherein the indicator markers are removable and are each color coded;

a ballistic reference card having data comprising distances correlating to colors of the indicator markers; and a ballistic card mounting system comprising a card holder for receiving the ballistic reference card, a movable portion attached to the card holder, and an attachment portion attachable to a forward portion of a riflescope or rifle, the movable portion providing a stow position for the card holder whereby the card therein is not viewable by a user of the firearm in a ready to shoot position and a viewable position where the card therein is viewable by the user of the firearm in the ready to shoot position.

10. The combination rifle with a riflescope and ballistic reference card mounting system of claim 1, wherein the distances comprise yardages.

11. The combination rifle with a riflescope and ballistic reference card mounting system of claim 1, wherein the movable portion is pivotally coupled to the attachment portion.

12. The riflescope of claim 6, wherein the movable portion is pivotally coupled to the attachment portion.

13. The riflescope of claim 6, wherein the movable portion includes a transparent portion.

14. The riflescope of claim 13, wherein the transparent portion is configured to cover a ballistics card received by movable portion.

15. The combination rifle and riflescope and ballistic reference card mounting system of claim 6 wherein the data comprising distances is displayed on the ballistic reference card in colors corresponding to colors of the plurality of indicator markers.

16. The indicator and ballistic card mounting system of claim 9, wherein the movable portion is pivotally coupled to the attachment portion, and the movable portion includes a transparent portion.

17. The indicator and ballistic card mounting system of claim 9, wherein the movable portion comprises a movable lens cover.

* * * * *